US011660496B2

(12) United States Patent
Taylor et al.

(10) Patent No.: US 11,660,496 B2
(45) Date of Patent: May 30, 2023

(54) EXERCISE BIKE

(71) Applicant: Blue Goji LLC, Austin, TX (US)

(72) Inventors: Edward Taylor, San Diego, CA (US); Christian Tucker, Aspendale (AU); Alexander T.h. Van Zoest, San Diego, CA (US); Ross Stensrud, Carlsbad, CA (US); William Stensrud, Reno, NV (US)

(73) Assignee: BLUE GOJI LLC, Austin, TX (US)

( * ) Notice: Subject to any disclaimer, the term of this patent is extended or adjusted under 35 U.S.C. 154(b) by 11 days.

(21) Appl. No.: 17/097,675

(22) Filed: Nov. 13, 2020

(65) Prior Publication Data

US 2022/0134179 A1 May 5, 2022

Related U.S. Application Data

(60) Provisional application No. 63/108,320, filed on Oct. 31, 2020.

(51) Int. Cl.
*A63B 22/06* (2006.01)
*A63B 24/00* (2006.01)
(Continued)

(52) U.S. Cl.
CPC ..... *A63B 22/0605* (2013.01); *A63B 21/0057* (2013.01); *A63B 21/015* (2013.01);
(Continued)

(58) Field of Classification Search
CPC ... A63B 21/005; A63B 21/0057; A63B 21/15; A63B 21/157; A63B 21/22;
(Continued)

(56) References Cited

U.S. PATENT DOCUMENTS 4,402,503 A * 9/1983 Galbierz ..... A63B 22/0605 194/242
4,673,177 A * 6/1987 Szymski ..... A63B 21/225 482/64

(Continued)

FOREIGN PATENT DOCUMENTS

WO WO-2011002302 A2 1/2011

OTHER PUBLICATIONS

International Search Report and Written Opinion regarding International Patent Application No. PCT/US2021/056136, dated Feb. 15, 2022.

*Primary Examiner* — Gary D Urbiel Goldner
(74) *Attorney, Agent, or Firm* — Galvin Patent Law LLC; Brian R. Galvin

(57) ABSTRACT

An exercise bike operable while remaining stationary on a support surface. The exercise bike includes a bicycle frame with a pedal assembly coupled to a clutch mechanism that is movable between an unlocked state in which the pedal assembly drives a wheel in a first rotational direction and rotates relative to the wheel in a second rotational direction, and a locked state in which the pedal assembly is rotationally fixed to the wheel to drive the wheel in the first rotational direction and the second rotational direction, and a handlebar assembly. The handlebar assembly is coupled to the bicycle frame and includes a handlebar and a locking mechanism. The locking mechanism is moveable between an unlocked position in which the handlebar is allowed to rotate about an axis, and a locked position in which the handlebar is restricted from rotating about the axis. A control module may move the locking mechanism and the clutch mechanism between their respective locked and unlocked states.

20 Claims, 15 Drawing Sheets

(51) Int. Cl.
*A63B 21/00* (2006.01)
*A63B 21/015* (2006.01)
*A63B 21/005* (2006.01)

(52) U.S. Cl.
CPC ..... *A63B 21/157* (2013.01); *A63B 21/4034* (2015.10); *A63B 21/4035* (2015.10); *A63B 21/4047* (2015.10); *A63B 24/0087* (2013.01)

(58) Field of Classification Search
CPC ..... A63B 21/4033; A63B 21/4034; A63B 21/4035; A63B 21/4047; A63B 21/4049; A63B 22/06; A63B 2022/0635; A63B 24/0087; A63B 2225/20; A63B 2225/50
See application file for complete search history.

(56) References Cited

U.S. PATENT DOCUMENTS 5,240,417 A * 8/1993 Smithson ..... A63F 13/803 348/121
5,431,614 A * 7/1995 Jeranson ..... B62M 1/16 482/57
5,551,718 A * 9/1996 Toronto ..... B62M 11/06 280/258
5,643,146 A * 7/1997 Stark ..... A63B 21/015 482/5
5,765,847 A * 6/1998 Toronto ..... B62M 1/28 474/84
5,918,894 A * 7/1999 Toronto ..... B62M 1/28 474/84
5,944,638 A * 8/1999 Maresh ..... A63B 22/0605 482/110
6,157,149 A * 12/2000 Ohnuma ..... B62M 6/70 318/140
2002/0155929 A1* 10/2002 Lull ..... A63B 22/0046 482/57
2002/0160887 A1* 10/2002 Warner ..... A63B 22/0605 482/57
2003/0224911 A1* 12/2003 Warner ..... F16D 41/24 482/57
2004/0053750 A1* 3/2004 Forcillo ..... A63B 21/00069 482/57
2004/0077465 A1* 4/2004 Schmidt ..... A63B 22/0012 482/57
2008/0058170 A1 3/2008 Giannascoli et al.
2009/0048076 A1* 2/2009 Irving ..... A63B 21/4034 482/57
2009/0170667 A1* 7/2009 Irving ..... A63B 21/015 482/57
2011/0237397 A1* 9/2011 Mabey ..... A63B 22/0605 482/4
2014/0221158 A1* 8/2014 Mabey ..... A63B 22/0046 482/4
2015/0290490 A1 10/2015 Badarneh
2018/0362105 A1 12/2018 Mori et al.
2019/0178313 A1 6/2019 Wrobel
2019/0381351 A1* 12/2019 Irving ..... A63B 21/015

* cited by examiner

EXERCISE BIKE

CROSS-REFERENCE TO RELATED APPLICATIONS

This application claims the benefit of U.S. Provisional Application No. 63/108,320, filed on Oct. 31, 2020. The entire disclosure of the above application is incorporated herein by reference.

FIELD

The present disclosure relates to an exercise bike.

BACKGROUND

Some exercise bikes are operable in a free wheel mode in which a pedal assembly drives a wheel in a first rotational direction and rotates relative to the wheel in a second rotational direction. Other exercise bikes are operable in a fixed wheel mode in which the pedal assembly is rotationally fixed to the wheel to drive the wheel in the first rotational direction and the second rotational direction. However, there remains a need for an exercise bike that is able to switch between a free wheel mode and a fixed wheel mode. The present disclosure provides an exercise bike that includes a clutch mechanism that is operable between an unlocked state in which the pedal assembly drives the wheel in a first rotational direction and rotates relative to the wheel in a second rotational direction, and a locked state in which the pedal assembly is rotationally fixed to the wheel to drive the wheel in the first rotational direction and the second rotational direction. Furthermore, the present disclosure also provides a handlebar assembly that is operable between an unlocked position in which the handlebar is allowed to rotate about an axis and a locked position in which the handlebar is restricted from rotating about the axis.

This section provides background information related to the present disclosure and is not necessarily prior art.

SUMMARY

This section provides a general summary of the disclosure, and is not a comprehensive disclosure of its full scope or all of its features.

In one form, the present disclosure provides an exercise bike that is operable while remaining stationary on a support surface. The bike includes a bicycle frame and a handlebar assembly. The handlebar assembly is coupled to the bicycle frame and includes a handlebar and a locking mechanism. The locking mechanism is moveable between an unlocked position in which the handlebar is allowed to rotate about an axis, and a locked position in which the handlebar is restricted from rotating about the axis.

In some configurations of the exercise bike of the above paragraph, a control module is in communication with the locking mechanism and configured to move the locking mechanism between the locked and unlocked positions.

In some configurations of the exercise bike of any one or more of the above paragraphs, the locking mechanism includes an actuator in communication with the control module, locking tabs, and a locking plate rotationally fixed to the handlebar. The control module is configured to operate the actuator between a first state in which the locking tabs are engaged with the locking plate to restrict rotation of the handlebar about the axis, and a second state in which the locking tabs are disengaged from the locking plate to allow rotation of the handlebar about the axis.

In some configurations of the exercise bike of any one or more of the above paragraphs, the actuator is a solenoid.

In some configurations of the exercise bike of any one or more of the above paragraphs, the control module is configured to move the locking mechanism to the locked position in response to a first input signal to operate the exercise bike in a first mode, and is configured to move the locking mechanism to the unlocked position in response to a second input signal to operate the exercise bike in a second mode.

In some configurations of the exercise bike of any one or more of the above paragraphs, when the locking mechanism is in the unlocked position, the handlebar is rotatable between a first position in which the handlebar extends perpendicular relative to a length of the bicycle frame and a second position in which the handlebar extends at a non-perpendicular angle relative to the length of the bicycle frame. The locking mechanism includes a spring coupled to the handlebar and biasing the handlebar toward the first position.

In some configurations of the exercise bike of any one or more of the above paragraphs, the locking mechanism includes a housing coupled to the bicycle frame and a locking plate partially disposed within the housing and rotationally fixed to the handlebar. The locking plate is configured to contact the housing to limit rotation of the handlebar in first and second rotational directions when the locking mechanism is in the unlocked position.

In some configurations of the exercise bike of any one or more of the above paragraphs, the housing includes opposing outer walls each having a slot formed therein. The locking plate is at least partially disposed within the slots and configured to abut against a side surface of each slot to limit rotation of the handlebar in first and second rotational directions when the locking mechanism is in the unlocked position.

In some configurations of the exercise bike of any one or more of the above paragraphs, the locking mechanism includes a pair of locking tabs that cooperate with the locking plate to restrict rotation of the handlebar when the locking mechanism is in the locked position.

In some configurations of the exercise bike of any one or more of the above paragraphs, the control module includes a processor and a storage medium having computer programmable instructions stored thereon, when executed by the processor, perform to send a signal to an actuator to operate the actuator between a first state in which rotation of the handlebar about the axis is restricted, and a second state in which rotation of the handlebar about the axis is allowed.

In some configurations of the exercise bike of any one or more of the above paragraphs, a user interface is in data communication with the control module. The user interface is able to receive an input command and send a signal to the control module to move the locking mechanism between the locked and unlocked positions.

In another form, the present disclosures discloses an exercise bike operable while remaining stationary on a support surface. The bike includes a bicycle frame, a wheel, a pedal assembly, a clutch mechanism, and a handlebar assembly. The wheel is rotatably coupled to the bicycle frame. The pedal assembly is coupled to the bicycle frame and configured to rotate the wheel. The clutch mechanism is coupled to the bicycle frame and the pedal assembly, and is movable between an unlocked state in which the pedal assembly drives the wheel in a first rotational direction and rotates relative to the wheel in a second rotational direction, and a locked state in which the pedal assembly is rotationally fixed to the wheel to drive the wheel in the first rotational direction and the second rotational direction. The handlebar assembly is coupled to the bicycle frame and includes a handlebar and a locking mechanism. The locking mechanism is moveable between an unlocked position in which the handlebar is allowed to rotate about an axis, and a locked position in which the handlebar is restricted from rotating about the axis.

In some configurations of the exercise bike of the above paragraph, a control module is in communication with the clutch mechanism and is configured to move the clutch mechanism between the locked and unlocked states.

In some configurations of the exercise bike of any one or more of the above paragraphs, the control module is in communication with the locking mechanism and is configured to move the locking mechanism between the locked and unlocked positions.

In some configurations of the exercise bike of any one or more of the above paragraphs, the clutch mechanism includes an actuator in communication with the control module. The control module is configured to operate the actuator between a first state to move the clutch mechanism to the unlocked state and a second state to move the clutch mechanism to the locked state.

In some configurations of the exercise bike of any one or more of the above paragraphs, the actuator is a solenoid.

In some configurations of the exercise bike of any one or more of the above paragraphs, the control module includes a processor and a storage medium having computer programmable instructions stored thereon, when executed by the processor, perform to send one or more signals to an actuator to operate the actuator between a first state in which the clutch mechanism is moved to the unlocked state, and a second state in which the clutch mechanism is moved to the locked state.

In some configurations of the exercise bike of any one or more of the above paragraphs, a user interface is in data communication with the control module. The user interface is able to receive an input command and send one or more signals to the control module to move the clutch mechanism between the locked and unlocked states.

In yet another form, the present disclosure discloses an exercise bike operable while remaining stationary on a support surface. The bike includes a bicycle frame, a wheel, a pedal assembly and a clutch mechanism. The wheel is rotatably coupled to the bicycle frame. The pedal assembly is coupled to the bicycle frame and is configured to rotate the wheel. The clutch mechanism is coupled to the bicycle frame and the pedal assembly, and is movable between an unlocked state in which the pedal assembly drives the wheel in a first rotational direction and rotates relative to the wheel in a second rotational direction, and a locked state in which the pedal assembly is rotationally fixed to the wheel to drive the wheel in the first rotational direction and the second rotational direction.

In some configurations of the exercise bike of the above paragraph, a control module is in communication with the clutch mechanism and is configured to move the clutch mechanism between the locked and unlocked states.

In some configurations of the exercise bike of any one or more of the above paragraphs, the clutch mechanism includes an actuator in communication with the control module. The control module is configured to operate the actuator between a first state to move the clutch mechanism to the unlocked state and a second state to move the clutch mechanism to the locked state.

In some configurations of the exercise bike of any one or more of the above paragraphs, the control module includes a processor and a storage medium having computer programmable instructions stored thereon, when executed by the processor, perform to send one or more signals to an actuator to operate the actuator between a first state in which the clutch mechanism is moved to the unlocked state, and a second state in which the clutch mechanism is moved to the locked state.

In some configurations of the exercise bike of any one or more of the above paragraphs, a user interface is in data communication with the control module. The user interface is able to receive an input command and send one or more signals to the control module to move the clutch mechanism between the locked and unlocked states.

In yet another form, the present disclosure discloses an exercise bike operable while remaining stationary on a support surface. The bike includes a bicycle frame, a wheel, a pedal assembly, a clutch mechanism, a handlebar assembly and a control module. The wheel is rotatably coupled to the bicycle frame. The pedal assembly is coupled to the bicycle frame and is configured to rotate the wheel. The clutch mechanism is coupled to the bicycle frame and movable between an unlocked state in which the clutch mechanism is disengaged from the wheel to allow the wheel to rotate relative to the pedal assembly, and a locked state in which the clutch mechanism is engaged with the wheel to rotationally fix the wheel to the pedal assembly. The handlebar assembly is coupled to the bicycle frame and includes a handlebar and a locking mechanism. The locking mechanism is moveable between an unlocked position in which the handlebar is allowed to rotate about an axis, and a locked position in which the handlebar is restricted from rotating about the axis. The control module is in communication with the clutch mechanism and the handlebar assembly and is configured to operate the bike in a first mode, a second mode, a third mode and a fourth mode. The control module is configured to move the handlebar assembly to the locked position and move the clutch mechanism to the locked state to operate the bike in the first mode. The control module is configured to move the handlebar assembly to the unlocked position and move the clutch mechanism to the unlocked state to operate the bike in the second mode. The control module is configured to move the handlebar assembly to the locked position and move the clutch mechanism to the unlocked state to operate the bike in the third mode. The control module is configured to move the handlebar assembly to the unlocked position and move the clutch mechanism to the locked state to operate the bike in the fourth mode.

In some configurations of the exercise bike of the above paragraph, the clutch mechanism includes a first actuator and the handlebar assembly includes a second actuator. The first and second actuators are in communication with the control module.

In some configurations of the exercise bike of any one or more of the above paragraphs, the control module includes a processor and a storage medium having computer programmable instructions stored thereon, when executed by the processor, perform to send one or more signals to at least one of the first and second actuators to operate the at least one of the first and second actuators between an ON state and an OFF state.

In some configurations of the exercise bike of any one or more of the above paragraphs, a user interface in data communication with the control module, and wherein the user interface is able to receive an input command and send one or more signals to the control module to operate the bike in one of the first, second, third and fourth modes.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1*a* is a perspective view of an exercise bike according to the principles of the present disclosure;

FIG. 1*b* is a perspective view of a resistance device of the exercise bike of FIG. 1;

Corresponding reference numerals indicate corresponding parts throughout the several views of the drawings.

DETAILED DESCRIPTION

Example embodiments will now be described more fully with reference to the accompanying drawings.

Figure 1A:
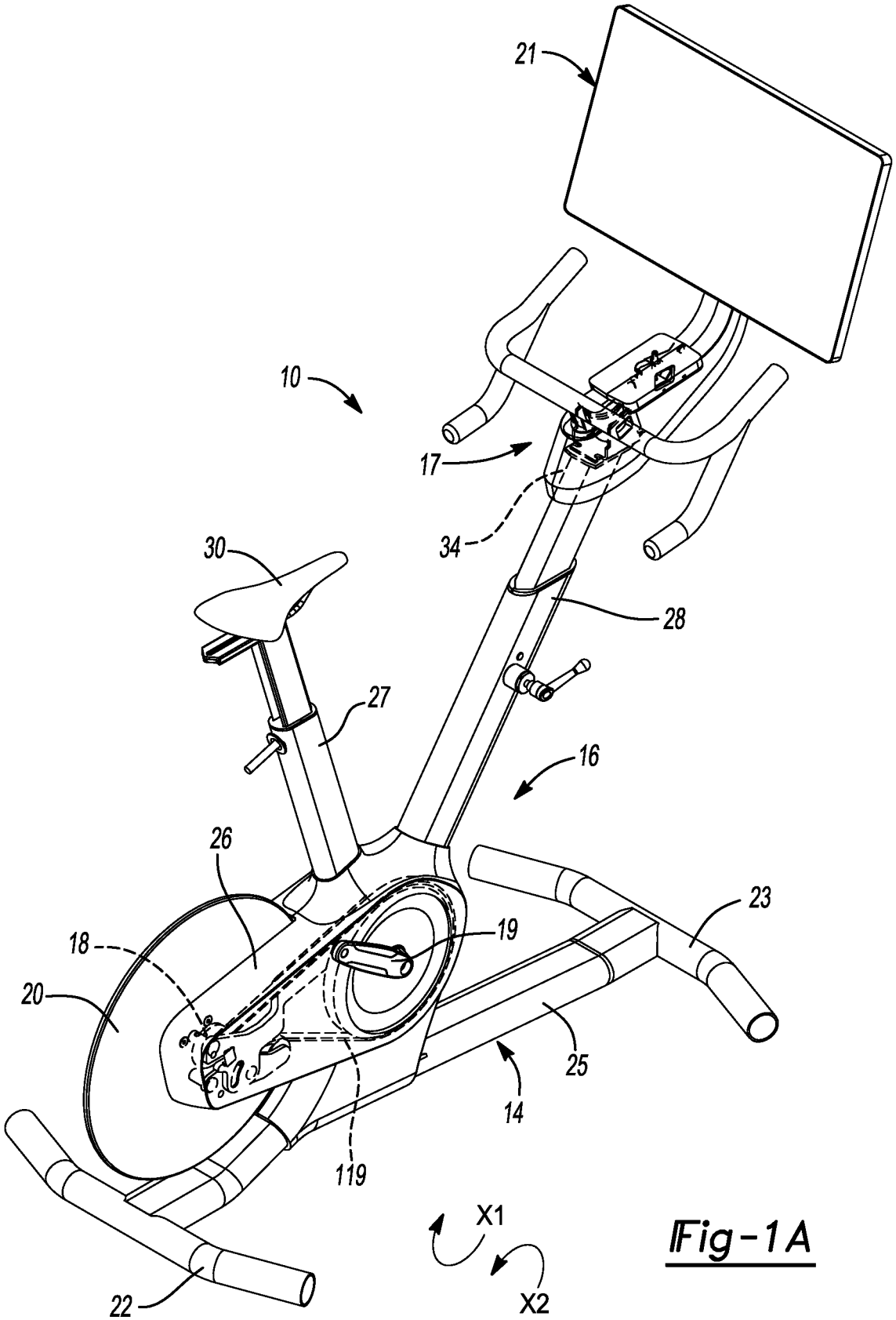
Figure 1B:
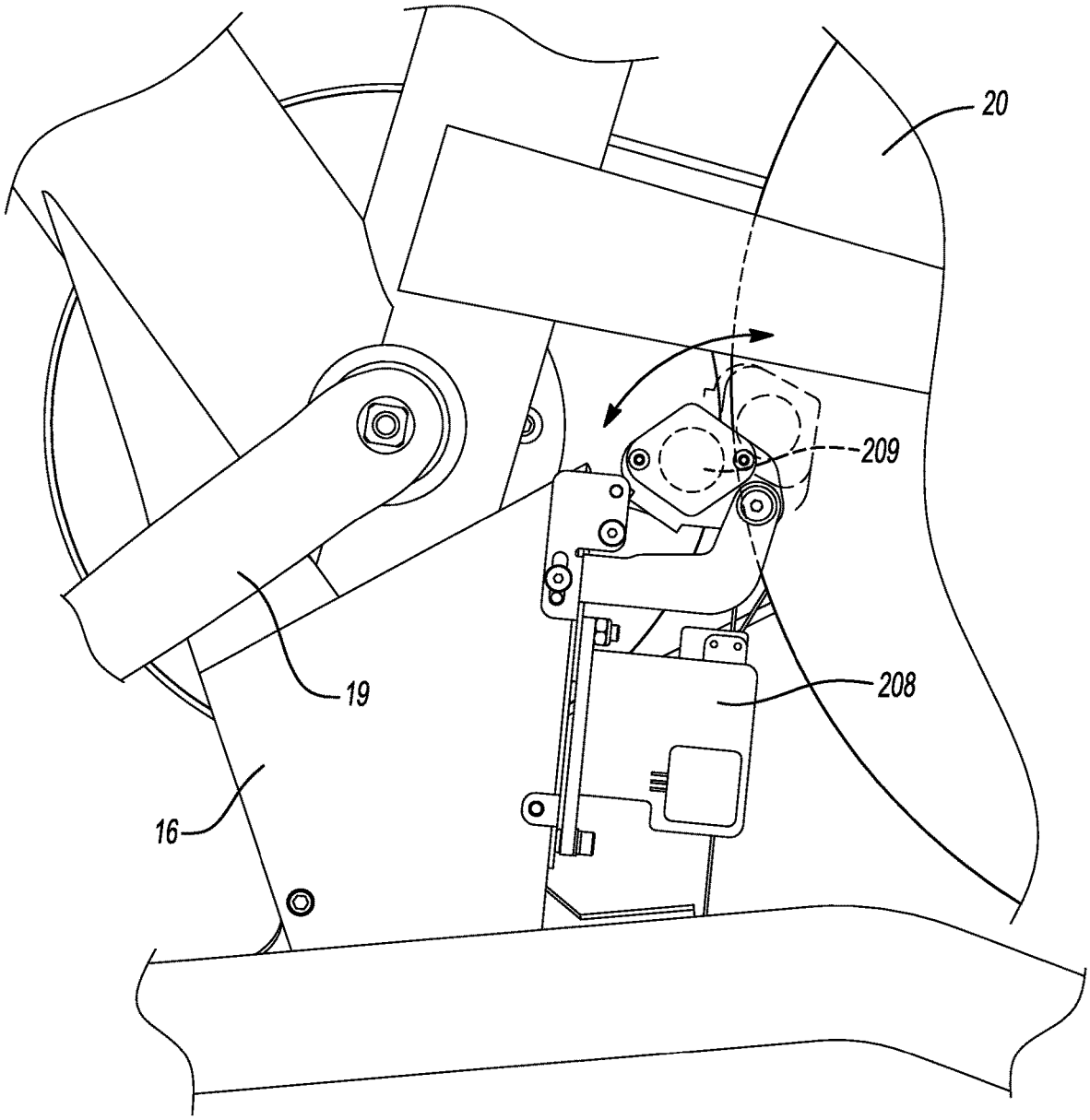
Figure 2:
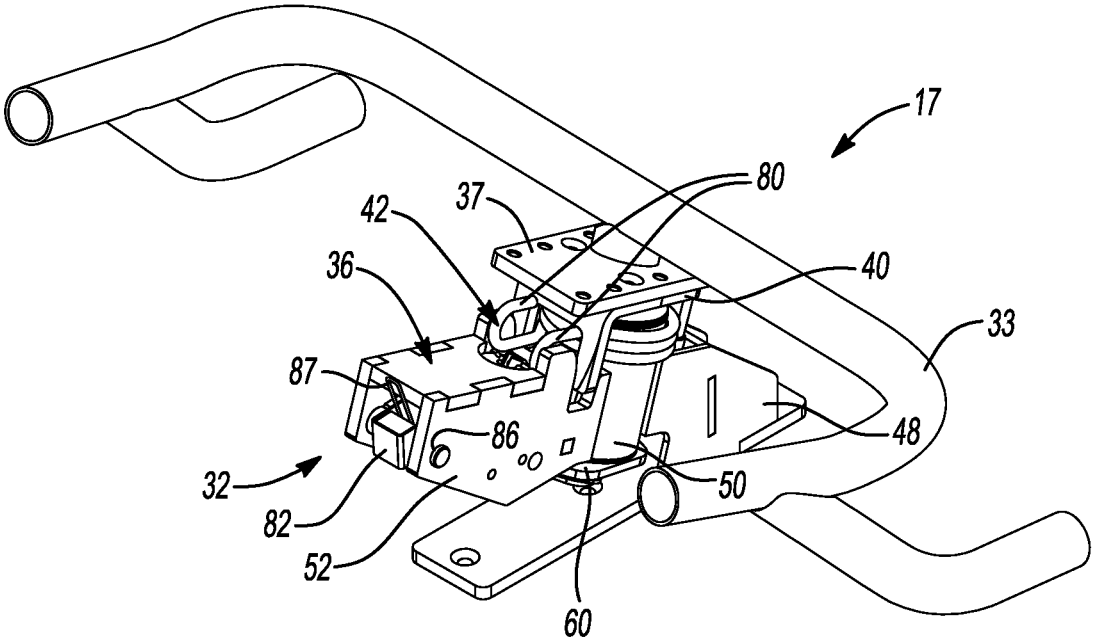
FIG. 2 is a perspective view of a handlebar assembly of the exercise bike of FIG. 1.
Figure 3:
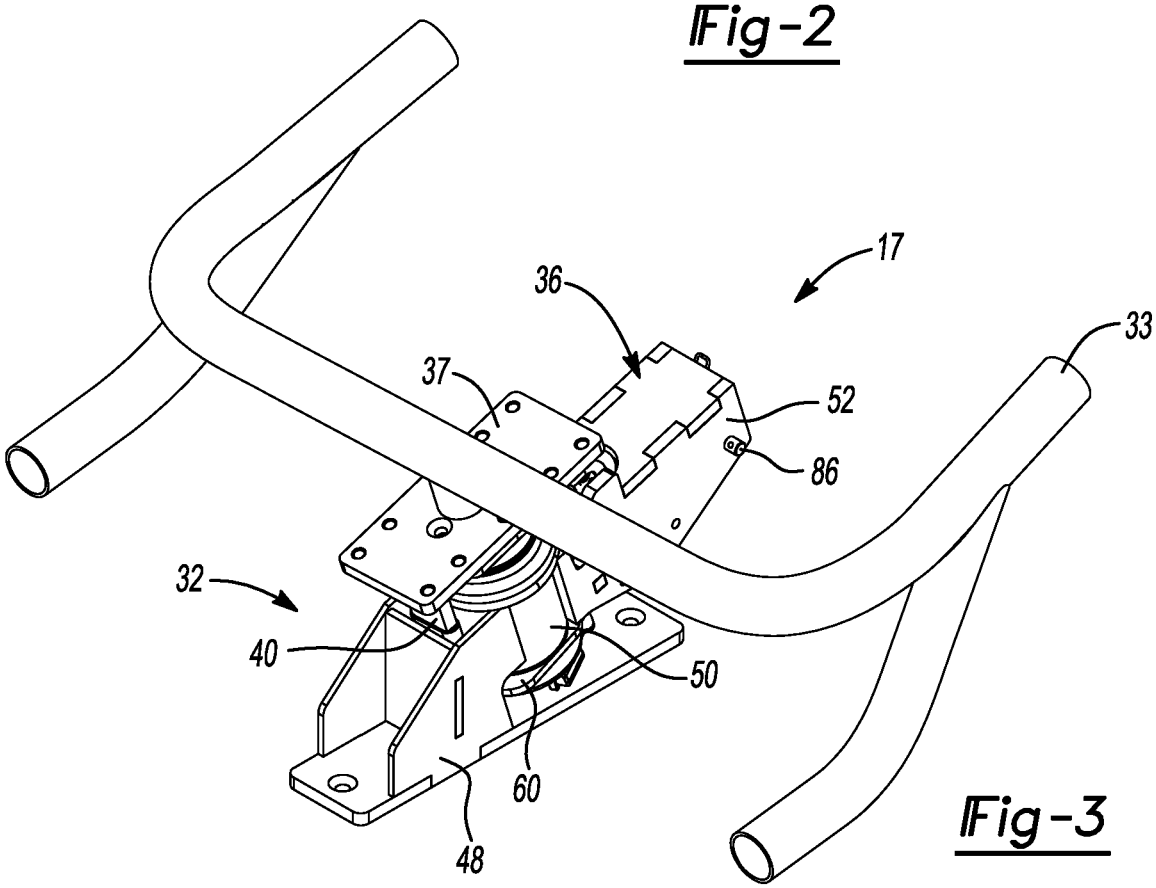
FIG. 3 is another perspective view of the handlebar assembly.

As shown in FIGS. 1*a* and 1*b*, an example embodiment of an exercise bike 10 is provided. While an example embodiment of exercise bike 10 is described herein, it is readily understood that the exercise bike 10 can take different forms. A user may operate the exercise bike 10 while the exercise bike 10 remains stationary on a support surface such as a ground surface. The exercise bike 10 may include a support assembly 14, a bicycle frame 16, a handlebar assembly 17, a clutch mechanism 18, a pedal assembly 19, a controllable variable resistance device 15 and a display unit 21. The support assembly 14 may include a first or rear leg 22, a second or front leg 23, and an elongated connecting bar 25 that connects the first leg 22 and the second leg 23. The first leg 22 and the second leg 23 are disposed on the support surface such that the bicycle frame 16 and a wheel 20 are lifted up off the support surface (a gap exists between the frame 16 and the support surface, and a gap exists between the wheel 20 and the support surface).

The bicycle frame 16 is connected to the connecting bar 25 of the support assembly 14 and includes a pedal housing 26, a seat support member 27, and a handlebar support member 28. A seat 30 may be connected to an end of the seat support member 27 such that a user may comfortably sit on the seat 30 while operating the exercise bike 10. The seat support member 27 may support the weight of the user and may be adjustable to facilitate users having different physical characteristics using the exercise bike 10. The handlebar support member 28 may support the handlebar assembly 17 and the display unit and may be adjustable to facilitate users having different physical characteristics using the exercise bike 10.

With reference to FIGS. 1-10, the handlebar assembly 17 is provided. While the present disclosure is being described with handlebar assembly 17, it is within the scope of the present disclosure to utilize different designs for the handlebar assembly without departing from the invention. The handlebar assembly 17 may be rotatably coupled to an end of the handlebar support member 28 and may be in communication with the display unit 21. The handlebar assembly 17 may include a locking mechanism 32 and a handlebar 33. The locking mechanism 32 is disposed within a cavity 34 of the handlebar support member 28 (is not viewable while using the exercise bike 10) and is moveable between an unlocked position in which the handlebar 33 is allowed to rotate about an axis 35, and a locked position in which the handlebar 33 is restricted from rotating about the axis 35.

With reference to FIGS. 2-10, the locking mechanism 32 includes a frame or housing 36, a mounting plate 37, a steering tube 38 (FIGS. 4-10), a locking plate 40, a spring 42 (FIGS. 2 and 4-10), and an actuating device 46 (FIGS. 4-8). The frame 36 extends parallel to a longitudinal direction of the bicycle frame 16 and includes a rear section 48, a cylindrical-shaped central section 50 and a front section 52. The central section 50 defines an opening 54 (FIGS. 4 and 7-10) that extends therethrough (i.e., the opening 54 extends from an upper end of the central section 50 to a bottom end of the central section 50).

Figure 4:
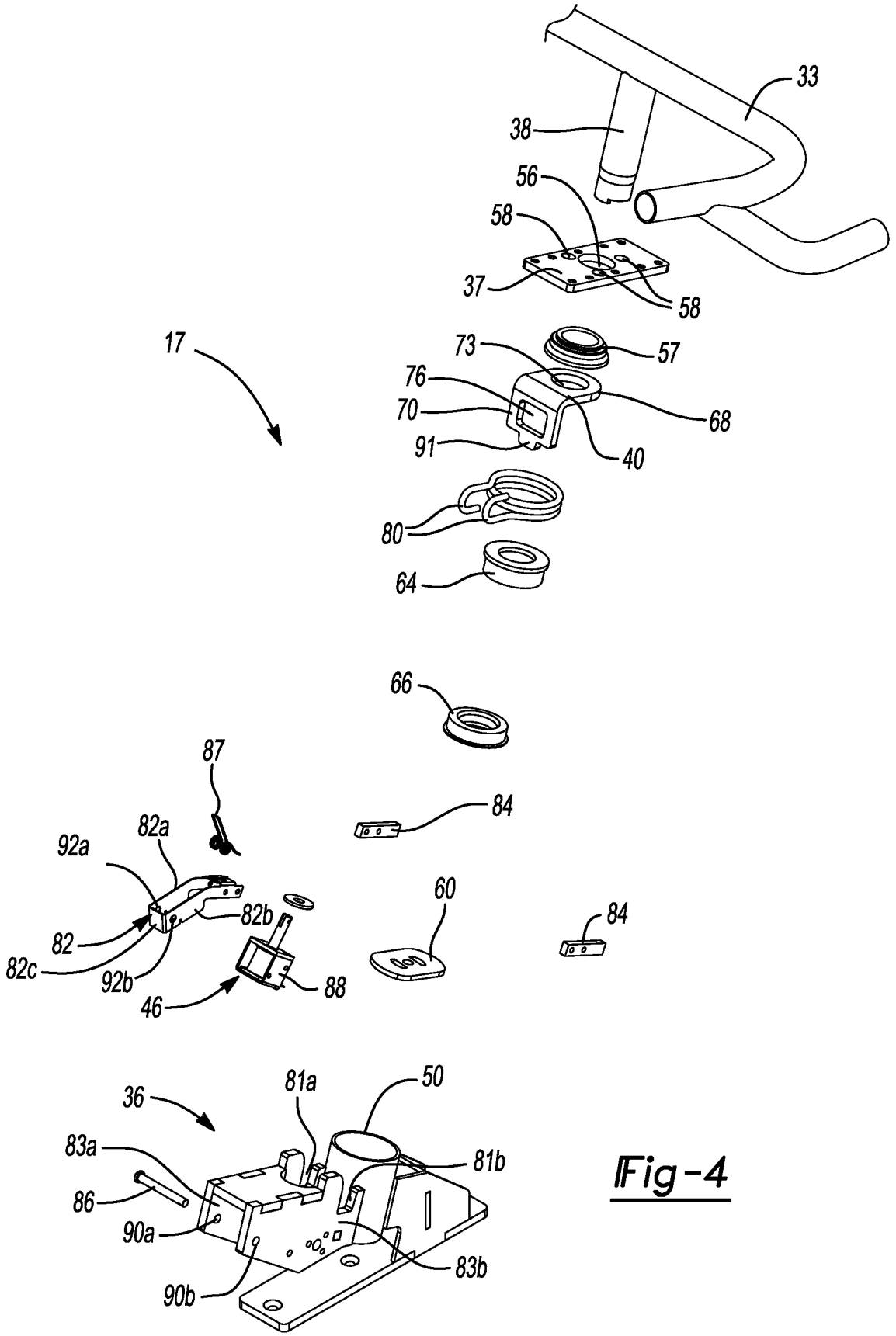
FIG. 4 is an exploded view of the handlebar assembly.
Figure 5:
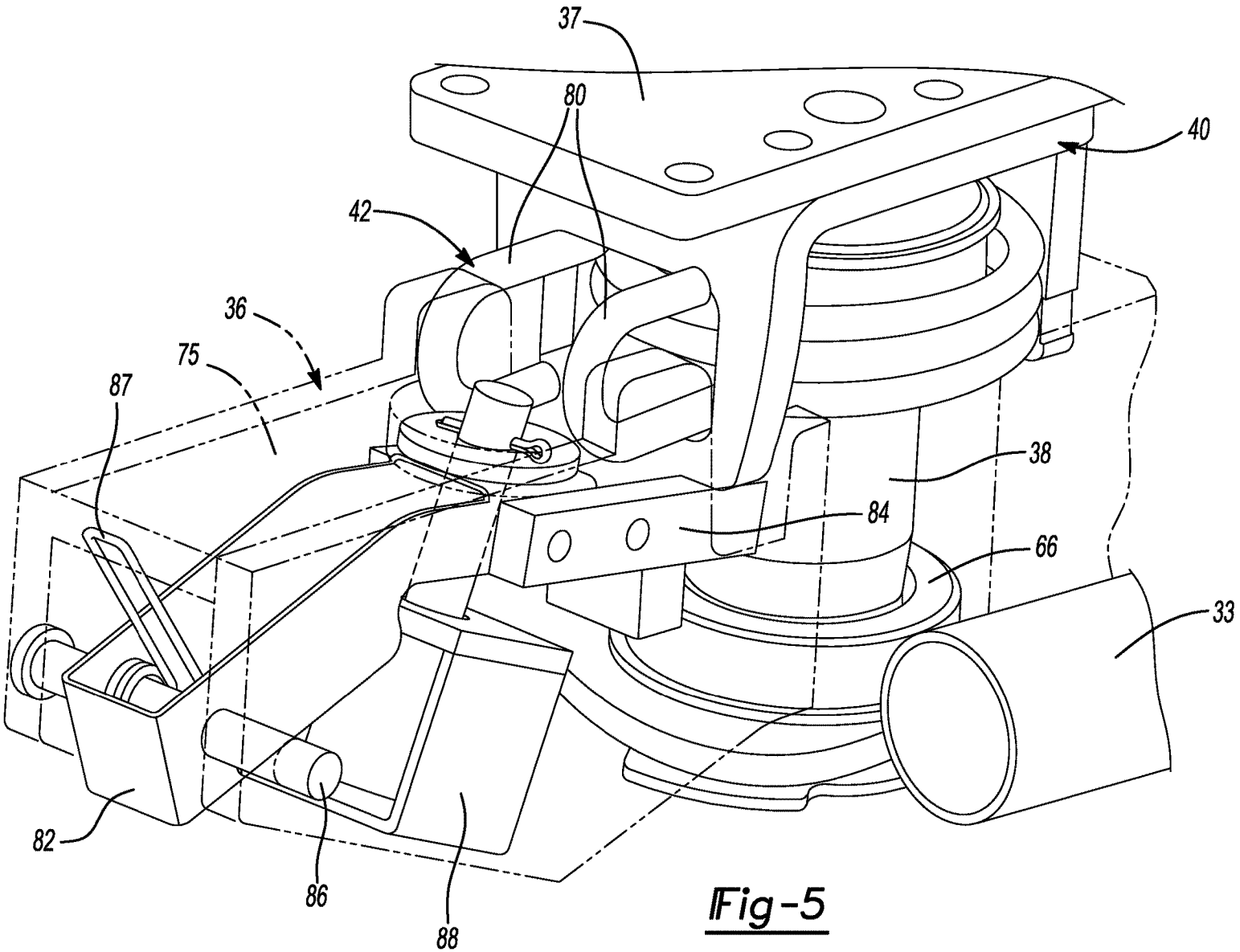
FIG. 5 is a perspective view of the handlebar assembly in a locked position with the housing in phantom lines for clarity.
Figure 6:
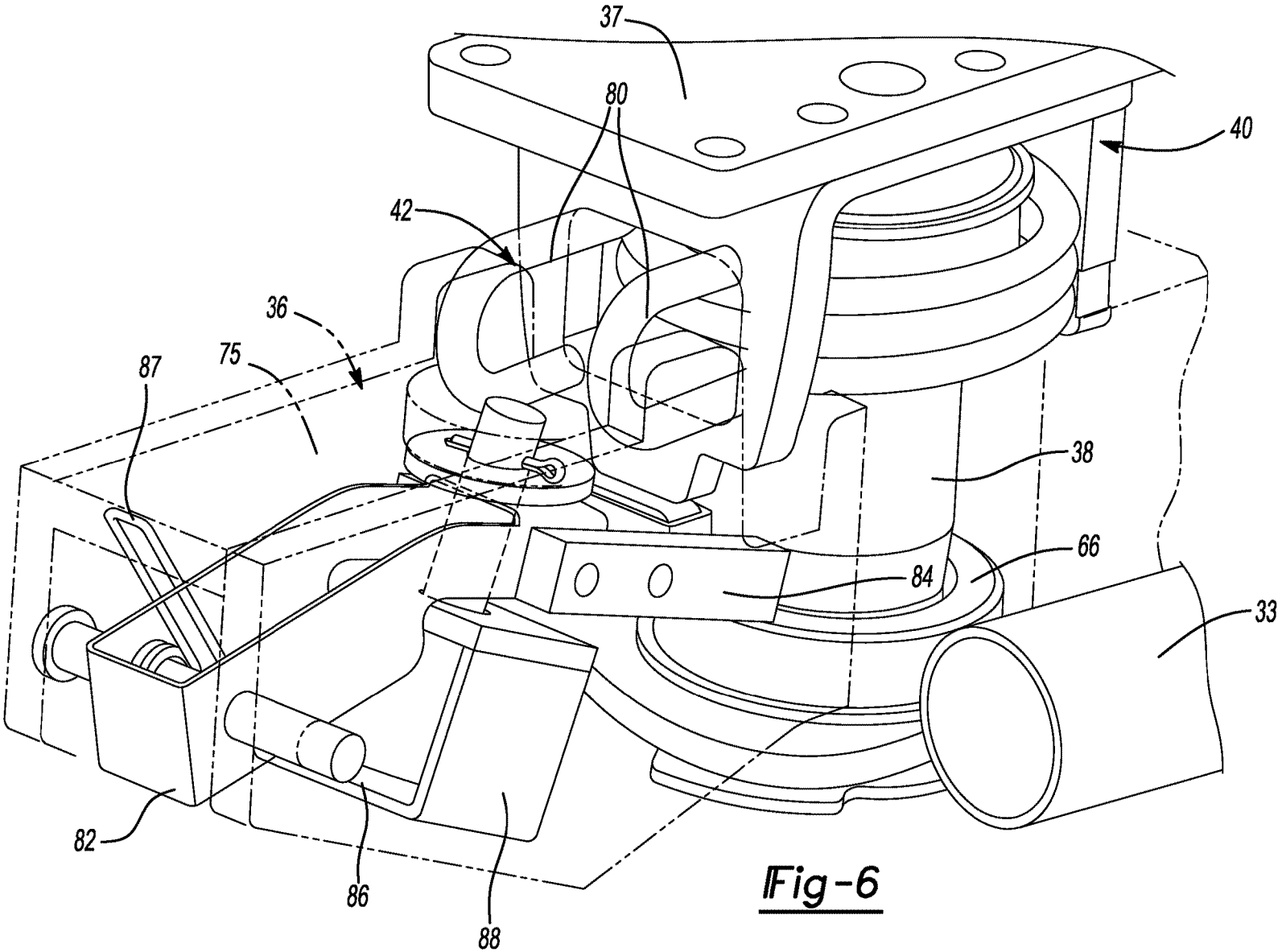
FIG. 6 is a perspective view of the handlebar assembly in an unlocked position with the housing in phantom lines for clarity.
Figure 7:
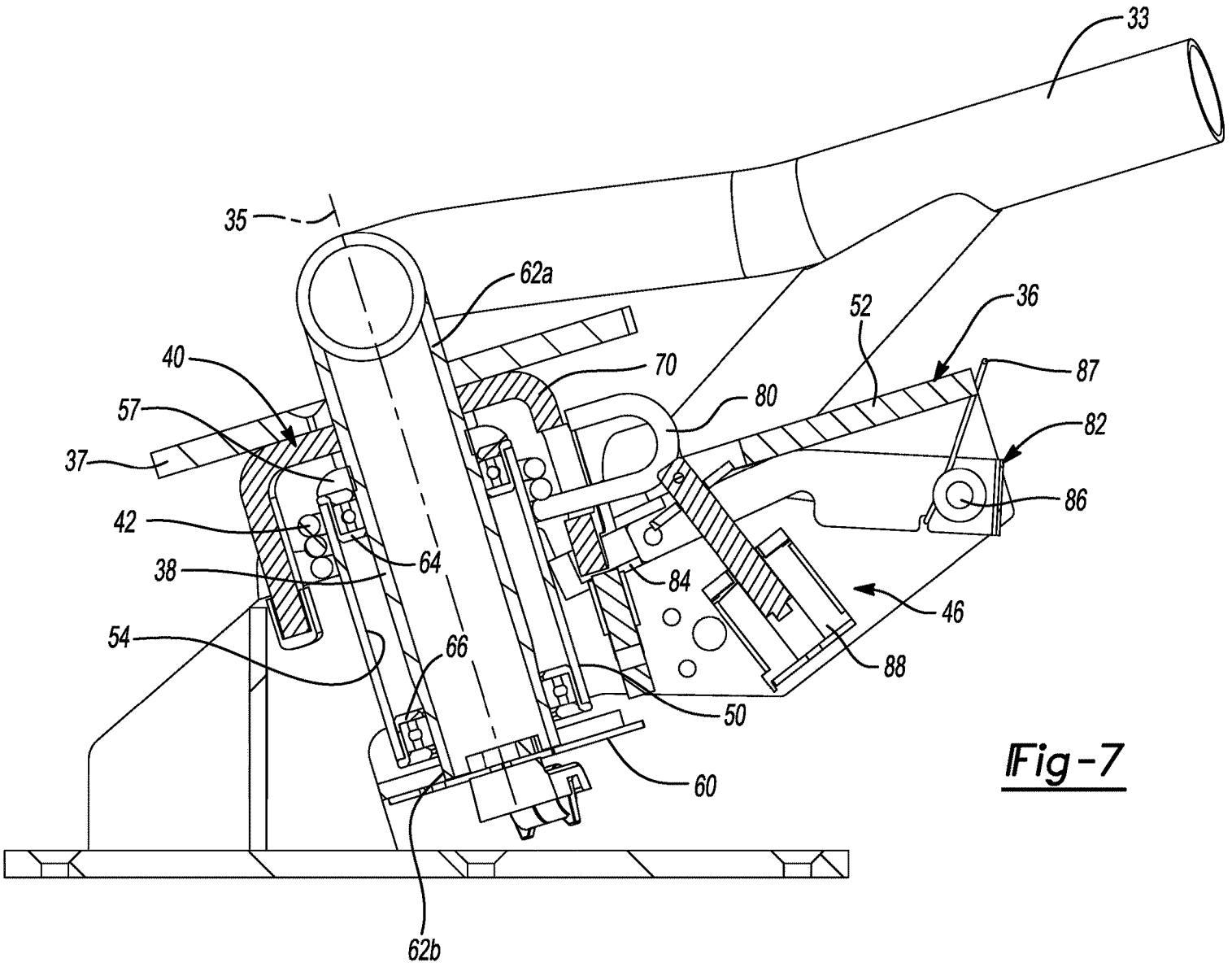
FIG. 7 is a cross-sectional view of the handlebar assembly in the locked position.
Figure 8:
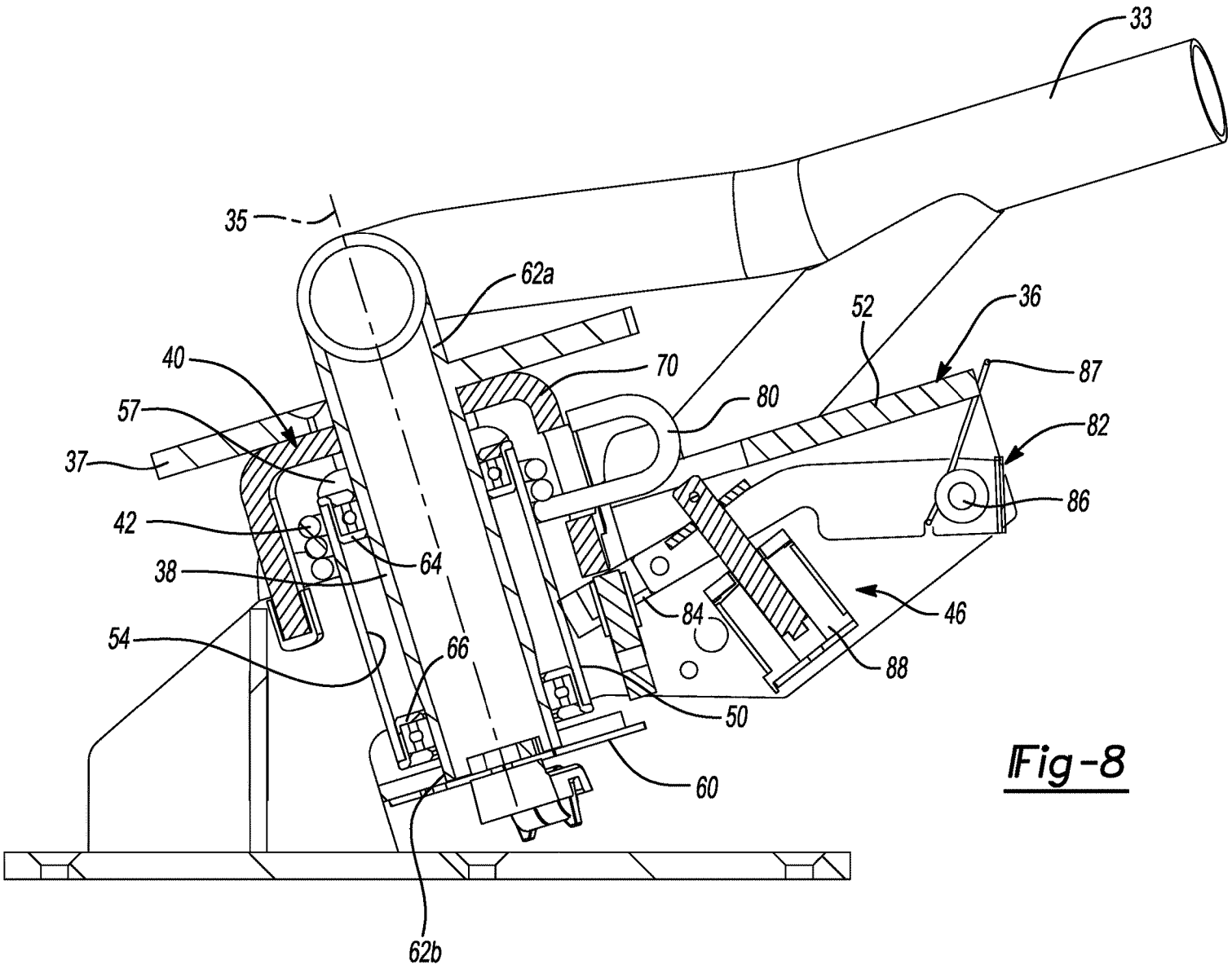
FIG. 8 is a cross-sectional view of the handlebar assembly in the unlocked position.
Figure 9:
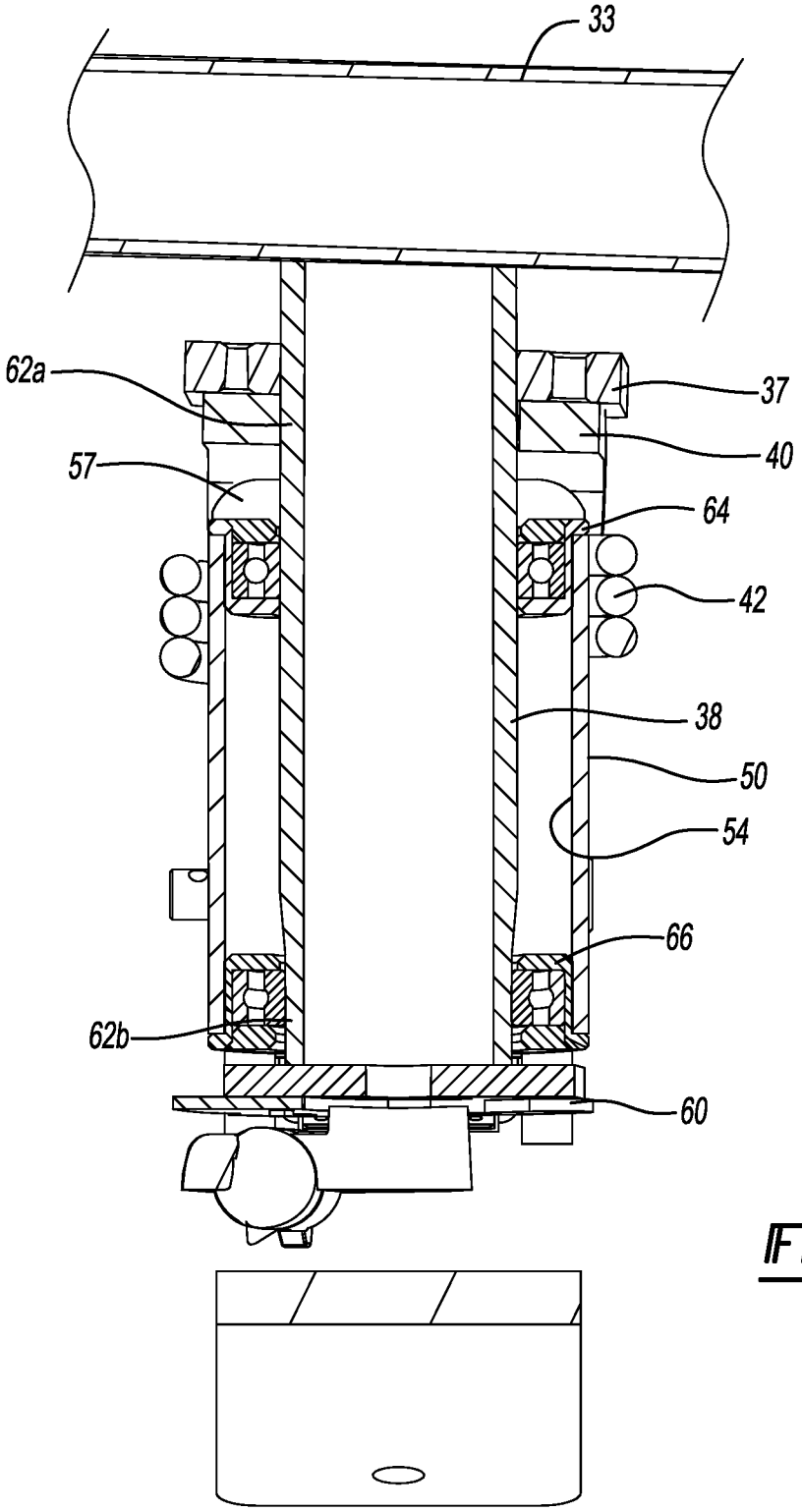
FIG. 9 is another cross-sectional view of the handlebar assembly in the locked position.

The mounting plate 37 is disposed between the handlebar 33 and the locking plate 40, and is rotationally fixed to the handlebar 33 and the locking plate 40. In this way, rotation of the handlebar 33 causes the mounting plate 37 and the locking plate 40 to rotate. As shown in FIG. 4, the mounting plate 37 includes a first aperture 56 located in a center of the plate 37 and second apertures 58 surrounding the first aperture 56. A fastener (not shown) may extend through the first aperture 56, the steering tube 38 and may be attached to an attachment plate 60 located at the bottom end of the central section 50 (FIGS. 7-10). In this way, rotation of the mounting plate 37 causes the attachment plate 60 to rotate.

As shown in FIGS. 7-10, the steering tube 38 may extend through the opening 54 of the central section 50. Stated differently, a first or upper end 62*a* of the steering tube 38 may contact the mounting plate 37 and locking plate 40, and a second or lower end 62*b* may contact and be at least partially supported by the attachment plate 60. The steering tube 38 defines the axis 35 that the handlebar 33 is allowed to rotate about when the locking mechanism 32 is in the unlocked positon. A first bushing 64 may be positioned within the opening 54 of the central section 50 and may be between the central section 50 and the first end 62*a* of the steering tube 38. Similarly, a second bushing 66 may be positioned within the opening 54 of the central section 50 and may be between the central section 50 and the second end 62*b* of the steering tube 38. The first and second bushings 64, 66 facilitate stabilization of the steering tube 38 within the central section 50. A collar spacer 57 is disposed axially between the first bushing 64 and the locking pate 40, and is supported by the first bushing 64.

The locking plate 40 is positioned between the mounting plate 37 and the frame 36 and includes a middle section 68 and a locking element 70. As shown in FIG. 4, the middle section 68 is generally rectangular-shaped and includes a first central aperture 73 extending therethrough. The first end 62*a* of the steering tube 38 may extend at least partially through the first aperture 73.

As shown in FIGS. 5-8, the locking element 70 extends perpendicularly from a front end of the middle section 68 (the locking element 70 extends parallel to the axis 35) and into a cavity 75 of the front section 52 of the frame 36. The locking element 70 may also be at least partially disposed within opposing grooves 81*a*, 81*b* formed in opposing side walls 83*a*, 83*b*, respectively, of the front section 52. When the locking mechanism 32 is in the unlocked position and the handlebar 33 is allowed to rotate about the axis 35, the locking element 70 may contact surfaces of the grooves 81*a*, 81*b* to limit rotation of the handlebar 33.

The spring 42 (e.g., a torsional spring) is disposed around the central section 50 of the frame 36 and includes ends 80 that extend through an opening 76 of the locking element 70 (the ends 80 also contact the first locking element 70). In this way, the spring 42 biases the handlebar 33 toward the original state (the state where the handlebar 33 extends perpendicular relative to a length of the exercise bike 10). Stated differently, when the locking mechanism 32 is in the unlocked position and the handlebar 33 has been rotated about the axis 35 from the original state, the spring 42 may rotational bias the handlebar 33 (via the mounting plate 37 and the locking plate 40) back to the original state when the user releases his or her grip of the handlebar 33.

As shown in FIGS. 5-8, the actuating device 46 may be disposed within the cavity 75 of the front section 52 of the frame 36 and is in communication with the display unit 21. The actuating device 46 may include a clip 82, a pair of metallic locking tabs 84, a pin 86, a spring 87, and an actuator 88 (e.g., solenoid). The clip 82 may be moveable between a locked state in which the locking mechanism 32 is in the locked position and an unlocked state in which the locking mechanism 32 is in the unlocked position. The clip 82 may include a first leg 82*a*, a second leg 82*b* and an end wall 82*c* that interconnects the first leg 82*a* and the second leg 82*b*. Each locking tab 84 may be coupled to a respective end of the first and second legs 82*a*, 82*b*. The side wall 83*a* of the front section 52 may include an aperture 90*a* and the side wall 83*b* of the front section 52 may include an aperture 90*b*. The apertures 90*a*, 90*b* are aligned with each other and with openings 92*a*, 92*b* of the first and second legs 82*a*, 82*b*, respectively. The pin 86 may extend through the apertures 90*a*, 90*b* and the openings 92*a*, 92*b* thereby pivotally connecting the clip 82 to the frame 36. The spring 87 is disposed around the pin 86 and coupled to the clip 82. In this way, the spring 87 biases the clip 82 toward the locked state.

The actuator 88 may be coupled to the front section 52 of the frame 36 and may be operable between a first state (OFF mode) and a second state (ON mode). When the actuator 88 is in the first state, the spring 87 biases the clip 82 toward the locked state (the locking tabs 84 are positioned between the side walls 83*a*, 83*b* and a tab 91 extending from the locking element 70) thereby restricting rotational movement of the handlebar 33, the mounting plate 37 and the locking plate 40 about the axis 35. When the actuator 88 is in the second state, the magnetic field generated by the actuator 88 causes the clip 82 to move toward the unlocked state, which causes the locking tabs 84 to move from between the side walls 83*a*, 83*b* and the tab 91. This, in turn, allows the handlebar 33, the mounting plate 37 and the locking plate 40 to rotate about the axis 35.

With reference to FIGS. 10-14, the clutch mechanism 18 is provided. While the present disclosure is being described with clutch mechanism 18, it is within the scope of the present disclosure to utilize different designs for the clutch assembly 18 without departing from the invention. The clutch mechanism 18 is coupled to the wheel 20 and the bicycle frame 16 and is movable between an unlocked state in which the pedal assembly 19 drives the wheel 20 in a first rotational direction X1 (FIG. 1) and rotates relative to the wheel 20 in a second rotational direction X2 (FIG. 2), and a locked state in which the pedal assembly 19 is rotationally fixed to the wheel 20 to drive the wheel 20 in the first rotational direction X1 and the second rotational direction X2. When the clutch mechanism 18 is in the unlocked state, the exercise bike 10 is in a free wheel mode and when the clutch mechanism 18 is in the locked state, the exercise bike 10 is in a fixed wheel mode.

The clutch mechanism 18 includes a shaft 94, a fastener 96, a clutch basket 97, a clutch hub 98, a first locking pate 100, a clutch plate 102 (FIGS. 11-14), a second locking plate 104 (FIGS. 11-14), a plurality of spacers 105 (FIGS. 11-14), a spring plate 106 (FIGS. 11-14), a plurality of springs 108 (FIGS. 11-14), a fork bushing 110 (FIGS. 11-14), and an actuator device 111. As shown in FIGS. 14 and 15, the shaft 94 may extend through the wheel 20, the clutch hub 98, the first locking plate 100, the clutch plate 102, the second locking plate 104 and at least partially through the clutch basket 97. The shaft 94 may include a central cavity 112 extending therethrough. The shaft 94 may also include a belt portion 114, a bearing portion 116 and an attachment portion 118. A belt 119 (FIG. 1) of the pedal assembly 19 may be drivingly engaged with teeth 117 on the belt portion 114 of the shaft 94. A one-way bearing 120 (e.g., a drawn cup needle bearing) may be disposed around and coupled to the bearing portion 116 of the shaft 94. The bearing 120 may also be disposed within and engage with the clutch hub 98. The attachment portion 118 is rotationally fixed to the clutch basket 97.

The fastener 96 extends through support members (not shown) of the bicycle frame 16, the cavity 112 of the shaft 94, the clutch basket 97, the spring plate 106, the fork bushing 110, and a connecting assembly 122. The fastener 96 may couple the clutch mechanism 18 to the support members of the bicycle frame 16 such that the support members support the clutch mechanism 18 and the connector assembly 122. The fastener 96 may include a first section 124, a second section 126, and a third section 128 disposed between first and second opposing ends 130*a*, 130*b* of the fastener 96. A first sleeve 132*a* may be disposed between the first section 124 and the belt portion 114, a second sleeve 132*b* may be disposed between the second section 126 and the bearing portion 116, and a third sleeve 132*c* may be disposed between the third section 128 and the spring plate 106 and the fork bushing 110. A collar 134 may also be disposed on the third section 128.

Figure 13:
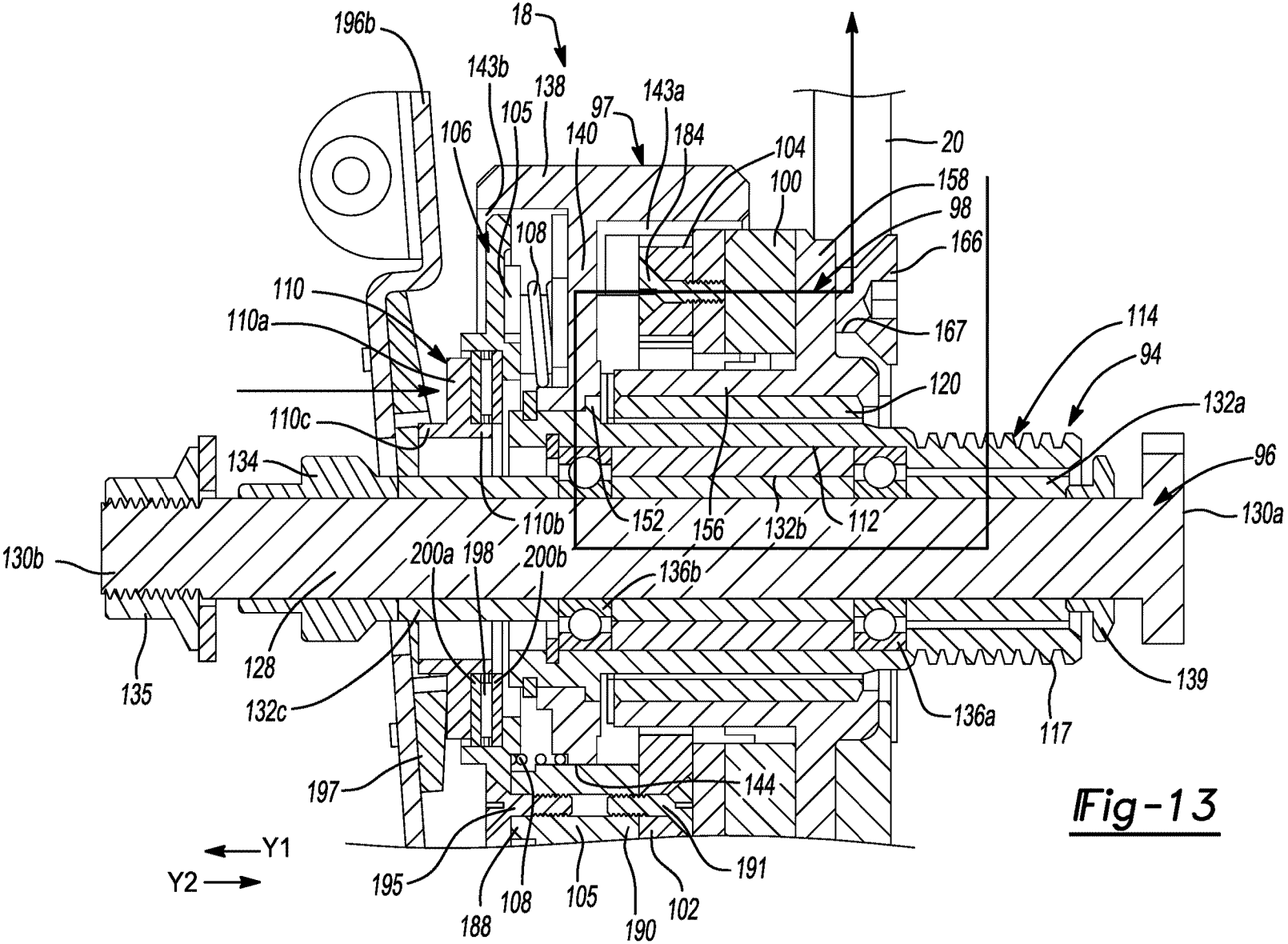
FIG. 13 is a cross-sectional view of the clutch mechanism in a locked state.
Figure 14:
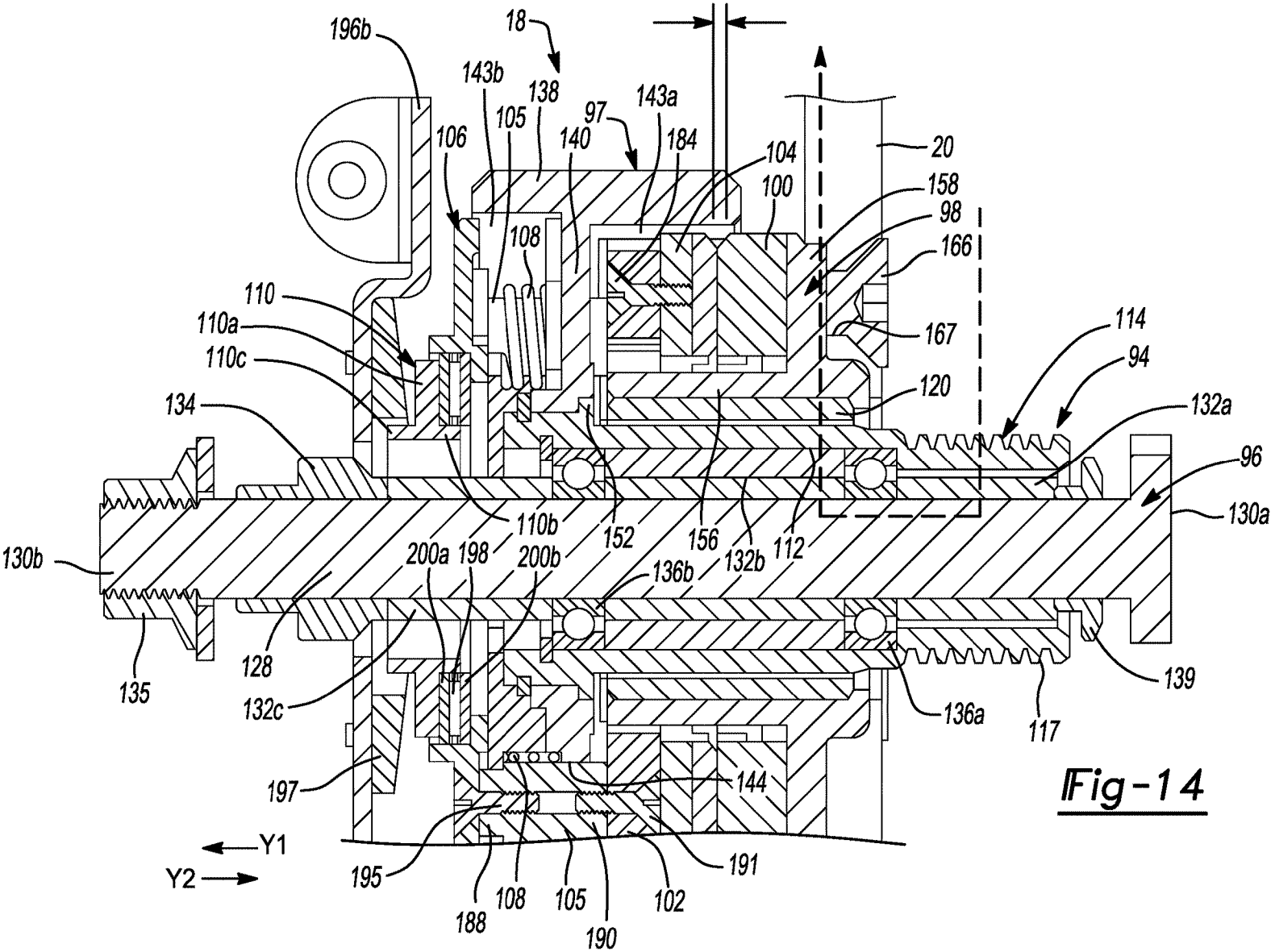
FIG. 14 is a cross-sectional view of the clutch mechanism in an unlocked state.
Figure 15:
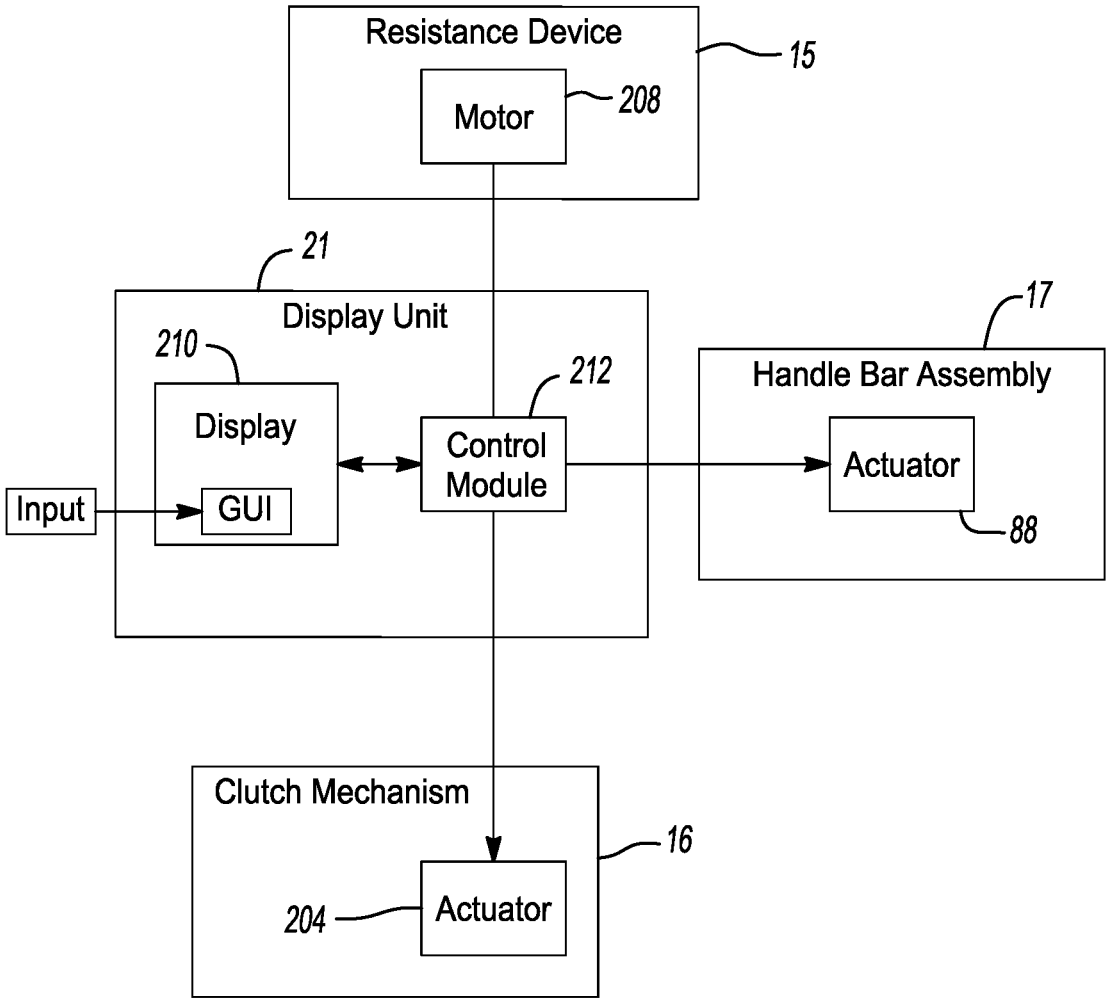
FIG. 15 is a block diagram illustrating communication between a display unit of the exercise bike and the clutch mechanism and the handlebar assembly of the exercise bike.

As shown in FIGS. 13 and 14, the first end 130*a* may include a fastener head and the second end 130*b* may have a nut 135 threadably engaged thereto. A first bearing 136*a* may be disposed within the cavity 112 of the shaft 94 and may rotatably support the fastener 96. The first bearing 136*a* may be positioned between the first sleeve 132*a* and the second sleeve 132*b*. Similarly, a second bearing 136*b* may be disposed within the cavity 112 of the shaft 94 and may also rotatably support the fastener 96. The second bearing 136*b* may be positioned between the second sleeve 132*b* and the third sleeve 132*c*. A retaining clip 137 may be positioned within the cavity 112 to assist in retaining the second bearing 136*b* in place. A plug 139 may be inserted into an end of the shaft 94 to restrict lateral movement of the first sleeve 132*a*.

Figure 10:
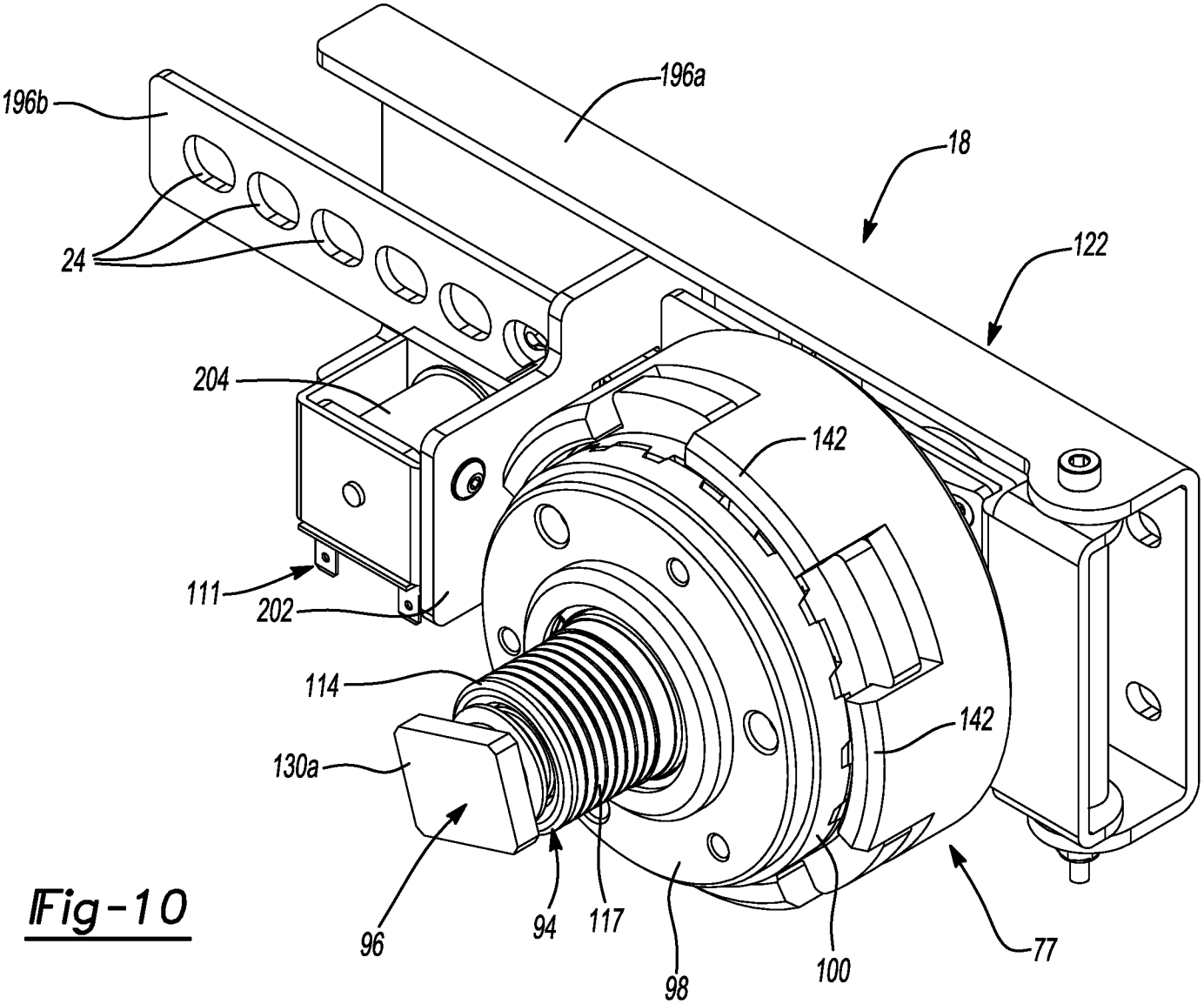
FIG. 10 is a perspective view of a clutch mechanism of the exercise bike of FIG. 1.
Figure 11:
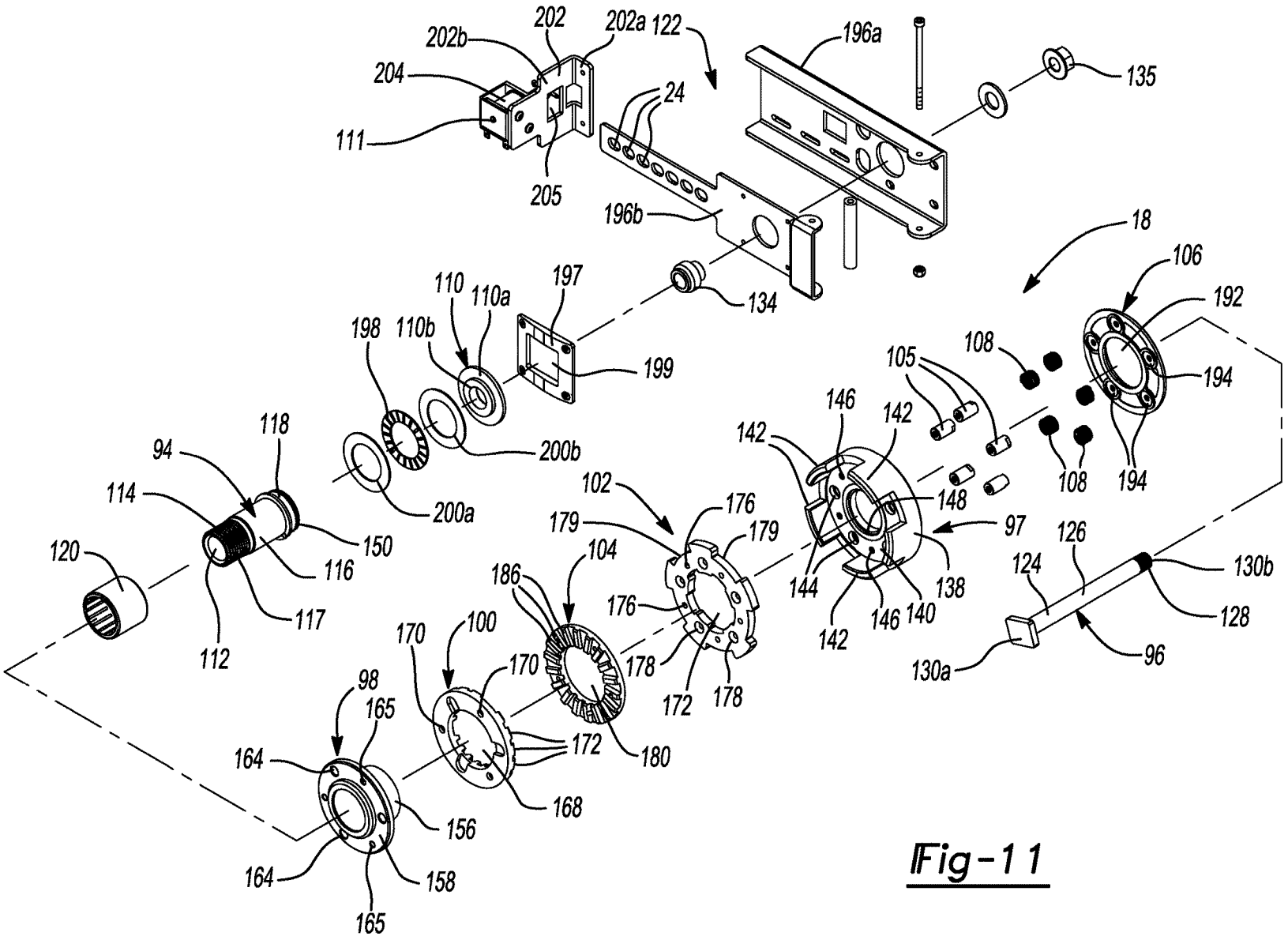
FIG. 11 is an exploded view of the clutch mechanism of FIG. 10.
Figure 12:
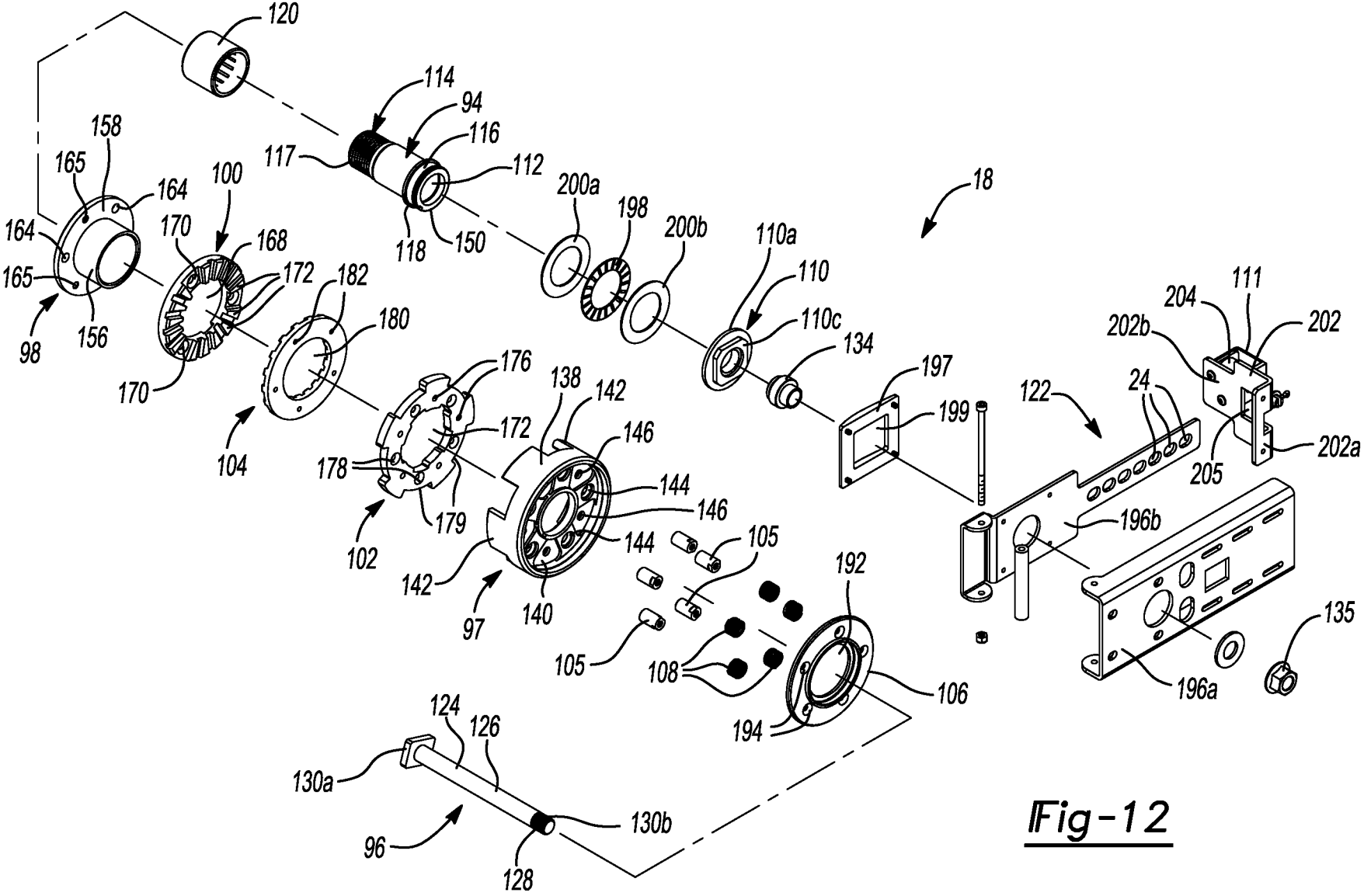
FIG. 12 is another exploded view of the clutch mechanism of FIG. 10.

The clutch basket 97 may include an outer hub 138, a partition 140, and an inner hub 141. Tabs 142 (FIGS. 10-12) may extend in an axial direction from an end surface of the outer hub 138. The tabs 142 may be circumferentially disposed around the end surface of the outer hub 138 and may also be spaced apart from each other. The partition 140 may interconnect the outer hub 138 and the inner hub 141. That is, the partition 140 may extend from an inner diametrical surface of the outer hub 138 and may extend from an outer diametrical surface of the inner hub 141. As shown in FIGS. 13 and 14, the partition 140 may cooperate with the outer hub 138 and the wheel 20 to define a partially enclosed space 143*a* that the clutch hub 98, the first locking plate 100, the clutch plate 102 and the second locking plate 104 are housed. The partition 140 may also cooperate with the outer hub 138 and the spring plate 106 to define a substantially enclosed space 143*b* that the springs 108 are housed. The spacers 105 are partially housed in both the first and second spaces 143*a*, 143*b*. As shown in FIGS. 11 and 12, the partition 140 may include a plurality of first apertures 144 and a plurality of second apertures 146 that are arranged in an alternating fashion around the partition 140. The inner hub 141 may include teeth 148 (FIG. 11) on an inner diametrical surface thereof that engaged with teeth 150 on the attachment portion 118 of the shaft 94. In this way, rotation of the shaft 94 causes corresponding rotation of the clutch basket 97. A retainer clip 151 may attach the inner hub 141 and the attachment portion 118 to each other to restrict lateral movement of the clutch basket 97. A protrusion 152 extending radially outwardly from the attachment portion 118 may be received in a groove formed in the inner hub 141 to further restrict lateral movement of the clutch basket 97.

The clutch hub 98 may be coupled to the wheel 20 and the first locking plate 100, and may include a hub portion 156 and a flange 158. Rotational movement of the shaft 94 in the first rotational direction X1 causes the clutch hub 98 to rotate in the first rotational direction X1. The one-way bearing 120 prevents the clutch hub 98 from rotating in the second rotational direction X2 when the shaft 94 rotates in the second rotational direction X2.

The flange 158 may extend radially outwardly from an end of the hub portion 156 and may be coupled to the wheel 20 (FIGS. 13 and 14). The flange 158 may include a plurality of first apertures 164 extending thererough and a plurality of second apertures 165 extending therethrough. The first and second apertures 164, 165 are arranged in an alternating fashion around the flange 158. Fasteners 166 may extend through apertures 167 of the wheel 20 and the first apertures 164 of the flange 158, thereby rotationally fixing the clutch hub 98 and the wheel 20 to each other.

The first locking plate 100 includes a central opening 168 extending therethrough and a plurality of apertures 170. The hub portion 156 of the clutch hub 98 may extend through the opening 168. The apertures 170 may be disposed circumferentially around the first locking plate 100. Fasteners may extend through the apertures 170 of the first locking plate 100 and the second apertures 165 of the flange 158, thereby rotationally fixing the first locking plate 100 and the clutch hub 98 to each other. In this way, when the shaft 94 rotates in the first rotational direction X1 (due to the user pedaling in the first rotational direction X1), rotational power is transmitted to the clutch hub 98 thereby rotating the clutch hub 98, the first locking plate 100, and the wheel 20 in the first rotational direction X1. When the shaft 94 rotates in the second rotational direction X2 (due to the user pedaling in the second rotational direction X2), the one-way bearing 120 prevents rotation of the clutch hub 98, the first locking plate 100 and the wheel 20 in the second rotational direction X2 (when the clutch mechanism 18 is in the unlocked state). The first locking plate 100 also includes teeth 172 extending from a surface thereof (the teeth 172 may extend in a direction opposite the wheel 20).

The clutch plate 102 includes a central opening 174 extending therethrough, a plurality of first apertures 176 and a plurality of second apertures 178. The hub portion 156 of the clutch hub 98 may extend through the opening 174. The first apertures 176 and the second apertures 178 may be arranged in an alternating fashion around the clutch plate 102. Grooves 179 maybe formed in and spaced apart around a periphery of the clutch plate 102. Tabs 142 of the clutch basket 97 may be received in respective grooves 179 thereby rotationally fixing the clutch basket 97 and the clutch pate 102 to each other.

The second locking plate 104 includes a central opening 180 extending therethrough and a plurality of apertures 182. The hub portion 156 of the clutch hub 98 may extend through the opening 180. The apertures 182 may be disposed circumferentially around the second locking plate 104. Fasteners 184 may extend through the first apertures 176 of the clutch plate 102 and the apertures 182 of the second locking plate 104 (FIGS. 13 and 14), thereby rotationally fixing the second locking plate 104 and the clutch plate 102 to each other. The second locking plate 104 also includes teeth 186 extending from a surface thereof (the teeth 186 may extend in a direction toward the wheel 20). The teeth 186 may also selectively engage the teeth 172 of the first locking plate 100. When the teeth 186 of the second locking plate 104 are engaged with the teeth 172 of the first locking plate 100, the clutch mechanism 18 is in the locked state. When the teeth 186 of the second locking plate 104 are disengaged with the teeth 172 of the first locking plate 100, the clutch mechanism 18 is in the unlocked state.

As shown in FIGS. 13 and 14, each cylindrical spacer 105 extends through a respective first aperture 144 of the partition 140 such that a first axial end 188 abuts against the spring plate 106 and the second axial end 190 abuts against the clutch plate 102. A fastener 191 may extend through a respective second aperture 178 of the clutch plate 102 and the second axial end 190 of a respective spacer 105 thereby attaching the clutch plate 102 and the spacer 105 to each other. The spring plate 106 may include a central opening 192 and a plurality of apertures 194. The apertures 194 are circumferentially disposed around the spring plate 106 and are spaced apart from each other. A fastener 195 may extend through a respective aperture 194 of the spring plate 106 and the first axial end 188 of a respective spacer 105 thereby attaching the spring plate 106 and the spacer 105 to each other. In this way, lateral movement of the spring plate 106 causes the clutch plate 102 and the second locking plate 104 to also move laterally, which, in turn, causes the teeth 186 of the second locking plate 104 to selectively engage the teeth 172 of the first locking plate 100.

As shown in FIGS. 13 and 14, each spring 108 may be disposed around a portion of a respective spacer 105 and may be positioned between the spring plate 106 and the partition 140 (a first end of the spring 108 contacts the spring plate 106 and a second end of the spring 108 contacts the partition 140). In this way, each spring 108 may bias the spring plate 106 toward a first lateral direction Y1, which, in turn, causes the teeth 186 of the second locking plate 104 to be disengaged from the teeth 172 of the first locking plate 100 (the clutch mechanism 18 being in the unlocked position).

The connector assembly 122 includes a first connecting plate 196*a*, a second connecting plate 196*b*, and a connector 197. The first connecting plate 196*a* is fixed to one of the support members. The second connecting plate 196*b* is pivotally coupled to the first connecting plate 196*a* and includes a plurality of horizontally aligned openings 201 therein (FIG. 10). The connecter 197 is attached to the second connecting plate 196*b* (FIGS. 13 and 14) and is generally rectangular-shaped. The connector 197 is positioned between the second connecting plate 196*b* and the fork bushing 110 and also defines an opening 199.

The fork bushing 110 is positioned between the connector 197 and the spring plate 106 and includes a first circular-shaped section 110*a*, a second circular-shaped section 110*b* and a third rectangular-shaped section 110*c*. The second section 110*b* may extend from a first side of the first section 110*a* and into the opening 192 of the spring plate 106. The third section 110*c* may extend from a second side of the first section 110*a* that is opposite the first side and may extend into the opening 199 of the connector 197. A thrust bearing 198 is disposed between the fork bushing 110 and the spring plate 106. Washers 200*a*, 200*b* are disposed on opposing sides of the bearing 198. The fastener 96 extends through the fork bushing 110, the bearing 198, the washers 200*a*, 200*b*, the connector 197, and the first and second connecting plates 196*a*, 196*b*.

The actuation device 111 is in communication with the display unit 21 and includes an attachment plate 202 (FIGS. 11 and 12) and an actuator 204 (FIGS. 11 and 12). The attachment plate 202 is L-shaped and is coupled to the first connecting plate 196*a*. The attachment plate 202 includes a first member 202*a* and a second member 202*b* extending perpendicularly from the first member 202*a*. The first member 202*a* is coupled to the first connecting plate 196*a* and the second connecting plate 196*b* extends through an opening 205 in the second member 202*b*.

The actuator 204 is coupled to the second member 202*b* and the second connecting plate 196*b* (via one or more pins extending through one of the openings 201 in the second connecting plate 196*b*). The actuator 204 may be operable between a first state (OFF mode) and a second state (ON mode). When the actuator 204 is in the first state, the first and second connecting plates 196*a*, 196*b* are parallel to each other and the springs 108 bias the spring plate 106 toward the first lateral direction Y1 which, in turn, causes the teeth 186 of the second locking plate 104 to be disengaged from the teeth 172 of the first locking plate 100 (the spring plate 106 moves the clutch plate 102 and the second locking plate 104 in the first lateral direction Y1 such that the teeth 186 of the second locking plate 104 are disengaged from the teeth 172 of the first locking plate 100).

When the actuator 204 is in the second state, the magnetic field generated by the actuator 204 causes the second connecting plate 196*b* to pivot toward the actuator 204, which causes the connector 197 to push against the fork bushing 110. This, in turn, causes the bearing 198 to push against the spring plate 106 which moves the spring plate 106 in the second lateral direction Y2 (the spring plate 106 overcomes the biasing force of the springs 108). Moving the spring plate 106 in the second lateral direction Y2 also moves the clutch plate 102 and the second locking plate 104 in the second lateral direction Y2, thereby causing the teeth 186 of the second locking plate 104 to be engaged with the teeth 172 of the first locking plate 100. In this way, the pedal assembly 19 is rotationally fixed to the wheel 20 to drive the wheel 20 in the first rotational direction X1 and the second rotational direction X2.

The pedal assembly 19 may be disposed at least partially within the pedal housing 26 and may include the drive belt 119, a ratchet plate (not shown) and first and second pedals. The drive belt 119 may be drivingly engaged with the ratchet plate and the belt portion 114 of the shaft 94. The pedals may be fixed for rotation with the ratchet plate. When the clutch mechanism 18 is in the unlocked state, rotation of the pedals in the first rotational direction X1 rotates the belt 119, the clutch mechanism 18 and the wheel 20 in the first rotational direction X1, and rotation of the pedals in the second rotational direction X2 rotates the belt 119 and various components of the clutch mechanism 18 in the second rotational direction X2 (the wheel 20, the first locking plate 100, and the clutch hub 98 do not rotate in the second rotational direction X2 due to the one-way bearing 120). In this way, the exercise bike 10 is in a free wheel mode and the wheel 20 continues to rotate in the first rotational direction X1 when the user stops pedaling in the first rotational direction X1 or pedals in the second rotational direction X2.

When the clutch mechanism 18 is in the locked state, rotation of the pedals in the first rotational direction X1 rotates the belt 119, the clutch mechanism 18 and the wheel 20 in the first rotational direction X1, and rotation of the pedals in the second rotational direction X2 rotates the belt 119, the clutch mechanism 18, and the wheel 20 in the second rotational direction X2. In this way, the exercise bike 10 is in a fixed wheel mode and the pedals continue rotating along with the wheel 20 in the first rotational direction X1 when the user stops pedaling (the wheel 20 also rotates in the second rotational direction X2 when the user pedals in the second rotational direction X2).

With reference to FIGS. 1*a*, 1*b*, and 15, the resistance device 15 is mounted to the bicycle frame 16 and includes the wheel 20, a motor 208 (e.g., a servo motor) and a magnet 209. The motor 208 is in communication with the display unit 21 and is configured to move the magnet 209 relative to a center of the wheel 20 to vary resistance of the wheel 20. That is, the motor 208 may move the magnet 209 toward the center of the wheel 20 to increase the magnetic field overlap with the wheel 20 thereby increasing resistance of the wheel 20 (requiring a greater amount of force applied to the pedal assembly 19 to rotate the wheel 20), and may move the magnet 209 away from the wheel 20 thereby decreasing resistance of the wheel 20 (requiring a lesser amount of force applied to the pedal assembly 19 to rotate the wheel 20).

With reference to FIGS. 1*a*, 1*b*, and 15, the display unit 21 includes a display 210 and a control module 212 (FIG. 16). When the handlebar assembly 17 is in the unlocked position, the degree of rotation of the display 210 may be continuously or intermittingly measured and communicated to the control module 212 to be used to allow the rider to steer the bike 10. The display 210 (e.g., a capacitive or other touchscreen display) is configured to provide graphical user interface (GUI) elements (FIG. 15) in order to enable a user to, for example, interact with the display unit 21 by touching the display 210. Additionally or alternatively, the display unit 21 may include a plurality of user interface (UI) elements, such as buttons, a keyboard, etc., that enable the user to interact with the display unit 21. Using one of the GUI and the UI elements, a user may select an exercise mode. In response to selecting the exercise mode, the control module 212 is configured to communicate with the handlebar assembly 17 and/or the clutch mechanism 18 to operate the handlebar assembly 17 and/or the clutch mechanism 18 in accordance with the selected exercise mode.

For example, when the user, using one of the GUI and UI elements, selects to operate the exercise bike 10 in a first mode where the handlebar assembly 17 is in the unlocked position and the clutch mechanism 18 in the locked state, the control module 212 is configured to operate the actuator 88 of the handlebar assembly 17 in the second state (ON mode) and the actuator 204 of the clutch mechanism 18 in the second state (ON mode). When the user, using one of the GUI and UI elements, selects to operate the exercise bike 10 in a second mode where the handlebar assembly 17 is in the unlocked position and the clutch mechanism 18 in the unlocked state, the control module 212 is configured to operate the actuator 88 of the handlebar assembly 17 in the second state (ON mode) and the actuator 204 of the clutch mechanism 18 in the first state (OFF mode).

When the user, using one of the GUI and UI elements, selects to operate the exercise bike 10 in a third mode where the handlebar assembly 17 is in the locked position and the clutch mechanism 18 in the unlocked state, the control module 212 is configured to operate the actuator 88 of the handlebar assembly 17 in the first state (OFF mode) and the actuator 204 of the clutch mechanism 18 in the first state (OFF mode). When the user, using one of the GUI and UI elements, selects to operate the exercise bike 10 in a fourth mode where the handlebar assembly 17 is in the locked position and the clutch mechanism 18 in the locked state, the control module 212 is configured to operate the actuator 88 of the handlebar assembly 17 in the first state (OFF mode) and the actuator 204 of the clutch mechanism 18 in the second state (ON mode).

The control module 212 is also configured to communicate with the motor 208 of the resistance device 15 to control resistance of the wheel 20 in accordance with the selected or desired resistance.

One of the benefits of the exercise bike 10 of the present disclosure is that the clutch mechanism 18 is allowed to move between the locked state in which the exercise bike 10 is in the fixed wheel mode and the unlocked state in which the exercise bike 10 is in the free wheel mode. The exercise bike 10 is allowed to move between the free wheel mode and the fixed wheel mode via the control module 212 of the display unit 21. The control module 212 can also continuously or intermittingly vary the resistance provided by a resistance module to match selected resistance to the experience being provided to the user/rider. Another benefit of the exercise bike 10 of the present disclosure is that the handlebar assembly 17 is allowed to move between the locked position in which the exercise bike 10 is in a non-gaming or terrain riding mode and the unlocked position in which the exercise bike 10 is in a gaming or terrain riding mode (the gaming mode allows the user to rotate the handlebar 33 to follow a path displayed on the display 210 or navigate as the rider desires). The exercise bike 10 is allowed to move between the non-gaming mode and the gaming mode via the control module 212 of the display unit 21.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In this application, including the definitions below, the term 'module' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An exercise bike operable while remaining stationary on a support surface, the exercise bike comprising:

a bicycle frame; and a handlebar assembly coupled to the bicycle frame and including a handlebar and a locking mechanism, the locking mechanism moveable between an unlocked position in which the handlebar is allowed to rotate about an axis, and a locked position in which the handlebar is restricted from rotating about the axis; and a control module in communication with the locking mechanism and configured to move the locking mechanism between the locked and unlocked positions;

wherein the locking mechanism includes:

an actuator electrically coupled to the control module; locking tabs; and a locking plate rotationally fixed to the handlebar; and wherein the control module is configured to operate the actuator between a first state in which the locking tabs are engaged with the locking plate to restrict rotation of the handlebar about the axis, and a second state in which the locking tabs are disengaged from the locking plate to allow rotation of the handlebar about the axis.

2. The exercise bike of claim 1, wherein the actuator is a solenoid.

3. The exercise bike of claim 1, wherein the control module is configured to move the locking mechanism to the locked position in response to a first input signal to operate the exercise bike in a first mode, and is configured to move the locking mechanism to the unlocked position in response to a second input signal to operate the exercise bike in a second mode.

4. The exercise bike of claim 1, wherein when the locking mechanism is in the unlocked position, the handlebar is rotatable between a first position in which the handlebar extends perpendicular relative to a length of the bicycle frame and a second position in which the handlebar extends at a non-perpendicular angle relative to the length of the bicycle frame, and wherein the locking mechanism includes a spring coupled to the handlebar and biasing the handlebar toward the first position.

5. The exercise bike of claim 1, wherein the locking mechanism comprises a housing coupled to the bicycle frame and the locking plate partially disposed within the housing and rotationally fixed to the handlebar, and wherein the locking plate is configured to contact the housing to limit rotation of the handlebar in the first and second rotational directions when the locking mechanism is in the unlocked position.

6. The exercise bike of claim 5, wherein the housing comprises opposing outer walls each having a slot formed therein, and wherein the locking plate is at least partially disposed within the slots and configured to abut against a side surface of each slot to limit rotation of the handlebar in the first and second rotational directions when the locking mechanism is in the unlocked position.

7. The exercise bike of claim 5, wherein the locking mechanism comprises a pair of locking tabs that cooperate with the locking plate to restrict rotation of the handlebar when the locking mechanism is in the locked position.

8. The exercise bike of claim 1, wherein the control module includes:

a processor; and a storage medium having computer programmable instructions stored thereon, that when executed by the processor, perform to send a signal to an actuator to operate the actuator between a first state in which rotation of the handlebar about the axis is restricted, and a second state in which rotation of the handlebar about the axis is allowed.

9. The exercise bike of claim 1, further comprising a user interface in data communication with the control module, and wherein the user interface is able to receive an input command and send a signal to the control module to move the locking mechanism between the locked and unlocked positions.

10. An exercise bike operable while remaining stationary on a support surface, the exercise bike comprising:

a bicycle frame;

a wheel rotatably coupled to the bicycle frame;

a pedal assembly coupled to the bicycle frame and configured to rotate the wheel;

a clutch mechanism coupled to the bicycle frame and the pedal assembly and movable between an unlocked state in which the pedal assembly drives the wheel in a first rotational direction and rotates relative to the wheel in a second rotational direction, and a locked state in which the pedal assembly is rotationally fixed to the wheel to drive the wheel in the first rotational direction and the second rotational direction; and a handlebar assembly coupled to the bicycle frame and including a handlebar and a locking mechanism, the locking mechanism comprising locking tabs and a locking plate, wherein the locking mechanism is moveable between an unlocked position in which the locking tabs are disengaged from the locking plate and the handlebar is allowed to rotate about an axis, and a locked position in which the locking tabs are engaged with the locking plate and the handlebar is restricted from rotating about the axis.

11. The exercise bike of claim 10, further comprising a control module in communication with the clutch mechanism and configured to move the clutch mechanism between the locked and unlocked states.

12. The exercise bike of claim 11, wherein the control module is in communication with the locking mechanism and configured to move the locking mechanism between the locked and unlocked positions.

13. The exercise bike of claim 11, wherein the clutch mechanism includes an actuator in communication with the control module, and wherein the control module is configured to operate the actuator between a first state to move the clutch mechanism to the unlocked state and a second state to move the clutch mechanism to the locked state.

14. The exercise bike of claim 13, wherein the actuator is a solenoid.

15. The exercise bike of claim 11, wherein the control module includes:

a processor; and a storage medium having computer programmable instructions stored thereon, that when executed by the processor, perform to send one or more signals to an actuator to operate the actuator between a first state in which the clutch mechanism is moved to the unlocked state, and a second state in which the clutch mechanism is moved to the locked state.

16. The exercise bike of claim 11, further comprising a user interface in data communication with the control module, and wherein the user interface is able to receive an input command and send one or more signals to the control module to move the clutch mechanism between the locked and unlocked states.

17. An exercise bike operable while remaining stationary on a support surface, the exercise bike comprising:

a bicycle frame;

a wheel rotatably coupled to the bicycle frame;

a pedal assembly coupled to the bicycle frame and configured to rotate the wheel;

a clutch mechanism coupled to the bicycle frame and movable between an unlocked state in which the clutch mechanism is disengaged from the wheel to allow the wheel to rotate relative to the pedal assembly, and a locked state in which the clutch mechanism is engaged with the wheel to rotationally fix the wheel to the pedal assembly;

a handlebar assembly coupled to the bicycle frame and including a handlebar and a locking mechanism comprising locking tabs and a locking plate, the locking mechanism moveable between an unlocked position in which the locking tabs are disengaged from the locking plate and the handlebar is allowed to rotate about an axis, and a locked position in which the locking tabs engage the locking plate and the handlebar is restricted from rotating about the axis; and a control module in communication with the clutch mechanism and the handlebar assembly and configured to operate the exercise bike in a first mode, a second mode, a third mode and a fourth mode, wherein the control module is configured to move the handlebar assembly to the locked position and move the clutch mechanism to the locked state to operate the exercise bike in the first mode, wherein the control module is configured to move the handlebar assembly to the unlocked position and move the clutch mechanism to the unlocked state to operate the exercise bike in the second mode, wherein the control module is configured to move the handlebar assembly to the locked position and move the clutch mechanism to the unlocked state to operate the exercise bike in the third mode, and wherein the control module is configured to move the handlebar assembly to the unlocked position and move the clutch mechanism to the locked state to operate the exercise bike in the fourth mode.

18. The exercise bike of claim 17, wherein the clutch mechanism includes a first actuator and the handlebar assembly includes a second actuator, and wherein the first and second actuators are in communication with the control module.

19. The exercise bike of claim 18, wherein the control module includes:

a processor; and a storage medium having computer programmable instructions stored thereon, that when executed by the processor, perform to send one or more signals to at least one of the first and second actuators to operate the at least one of the first and second actuators between an ON state and an OFF state.

20. The exercise bike of claim 17, further comprising a user interface in data communication with the control module, and wherein the user interface is able to receive an input command and send one or more signals to the control module to operate the exercise bike in one of the first, second, third and fourth modes.

* * * * *